US009316057B2

(12) United States Patent
Chen et al.

(10) Patent No.: US 9,316,057 B2
(45) Date of Patent: Apr. 19, 2016

(54) ROTARY DRILL BITS WITH PROTECTED CUTTING ELEMENTS AND METHODS

(75) Inventors: Shilin Chen, The Woodlands, TX (US); William W. King, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 588 days.

(21) Appl. No.: 13/540,451

(22) Filed: Jul. 2, 2012

(65) Prior Publication Data

US 2013/0013267 A1 Jan. 10, 2013

Related U.S. Application Data

(62) Division of application No. 12/525,249, filed as application No. PCT/US2008/052468 on Jan. 30, 2008, now Pat. No. 8,210,288.

(60) Provisional application No. 60/887,459, filed on Jan. 31, 2007.

(51) Int. Cl.

| | |
|---|---|
| ***G06G 7/48*** | (2006.01) |
| ***E21B 10/55*** | (2006.01) |
| ***E21B 10/567*** | (2006.01) |
| ***E21B 10/573*** | (2006.01) |

(52) U.S. Cl.

CPC ..... *E21B 10/55* (2013.01); *E21B 10/567* (2013.01); *E21B 10/5735* (2013.01)

(58) Field of Classification Search

None

See application file for complete search history.

(56) References Cited

U.S. PATENT DOCUMENTS

| | | | | |
|---|---|---|---|---|
| 4,397,361 | A | 8/1983 | Langford, Jr. | 175/329 |
| 5,028,177 | A | 7/1991 | Meskin et al. | 408/145 |
| 5,533,582 | A | 7/1996 | Tibbitts | 175/430 |
| 5,595,252 | A * | 1/1997 | O'Hanlon | 175/57 |
| 5,815,413 | A * | 9/1998 | Hively et al. | 702/191 |
| 5,868,213 | A | 2/1999 | Cisneros et al. | 175/331 |
| 5,947,216 | A | 9/1999 | Truax et al. | 175/432 |
| 6,003,623 | A | 12/1999 | Miess | 175/430 |
| 6,045,440 | A | 4/2000 | Johnson et al. | 451/540 |
| 6,109,368 | A * | 8/2000 | Goldman et al. | 175/39 |
| 6,202,770 | B1 | 3/2001 | Jurewicz et al. | 175/428 |
| 6,234,261 | B1 | 5/2001 | Evans et al. | 175/374 |
| 6,374,926 | B1 * | 4/2002 | Goldman et al. | 175/39 |
| 6,408,953 | B1 * | 6/2002 | Goldman et al. | 175/39 |
| 6,581,699 | B1 * | 6/2003 | Chen et al. | 175/61 |
| 6,672,406 | B2 | 1/2004 | Beuershausen | 175/57 |

(Continued)

OTHER PUBLICATIONS

International Search Report & Written Opinion; PCT/US2008/052468; pp. 12, Jun. 25, 2008.

*Primary Examiner* — Omar Fernandez Rivas
*Assistant Examiner* — Cuong Luu
(74) *Attorney, Agent, or Firm* — Baker Botts L.L.P.

(57) ABSTRACT

A rotary drill bit with cutting elements operable to control depth of cut and rate of penetration during formation of a wellbore are provided. Respective sets of secondary cutting elements and primary cutting elements may also be disposed on exterior portions of a rotary drill bit. A number of blades may extend from exterior portions of the drill bit with a number of cutting elements disposed on exterior portions of each blade. Each cutting element may include a substrate with a cutting surface disposed thereon. A respective protector may extend from the cutting surface of one or more cutting elements to limit depth of penetration of the associated cutting element into adjacent portions of a downhole formation and/or to control rate of penetration of an associated rotary drill bit.

10 Claims, 13 Drawing Sheets

(56) References Cited

U.S. PATENT DOCUMENTS

| | | | | |
|---|---|---|---|---|
| 6,845,828 | B2 | 1/2005 | Boyce | 175/420.2 |
| 6,879,947 | B1 * | 4/2005 | Glass | 703/10 |
| 6,904,984 | B1 | 6/2005 | Estes et al. | 175/430 |
| 7,083,010 | B2 | 8/2006 | Eppink et al. | 175/325.2 |
| 7,703,559 | B2 | 4/2010 | Shen et al. | 175/432 |
| 2003/0015351 | A1 * | 1/2003 | Goldman et al. | 175/39 |
| 2004/0069531 | A1 * | 4/2004 | McCormick et al. | 175/57 |
| 2004/0134687 | A1 | 7/2004 | Radford et al. | 175/57 |
| 2008/0091290 | A1 * | 4/2008 | Kubota et al. | 700/110 |

* cited by examiner

ROTARY DRILL BITS WITH PROTECTED CUTTING ELEMENTS AND METHODS

CROSS REFERENCE TO RELATED APPLICATIONS

This application is a Divisional of U.S. patent application Ser. No. 12/525,249 filed Jul. 30, 2009 now U.S. Pat. No. 8,210,288, which is a U.S. National Stage Application of International Application No. PCT/US2008/052468 filed Jan. 30, 2008, which designates the United States of America, and claims the benefit under 35 U.S.C. §119(e) of U.S. Provisional Application No. 60/887,459, filed Jan. 31, 2007, the contents of which are hereby incorporated by reference in their entirety.

TECHNICAL FIELD

The present disclosure is related to downhole tools used to form wellbores including, but not limited to, rotary drill bits and other downhole tools having cutting elements and more particularly to improving downhole performance by controlling depth of cut for each cutting element and rate of penetration for an associated drill bit.

BACKGROUND OF THE DISCLOSURE

Various types of rotary drill bits, reamers, stabilizers and other downhole tools may be used to form a borehole in the earth. Examples of such rotary drill bits include, but not limited to, fixed cutter drill bits, drag bits, PDC drill bits and matrix drill bits used in drilling oil and gas wells. Cutting action associated with such drill bits generally requires rotation of associated cutting elements into adjacent portions of a downhole formation. Typical drilling action associated with rotary drill bits includes cutting elements which penetrate or crush adjacent formation materials and remove the formation materials using a scraping action. Drilling fluid may also be provided to perform several functions including washing away formation materials and other downhole debris from the bottom of a wellbore, cleaning associated cutting structures and carrying formation cuttings radially outward and then upward to an associated well surface.

A typical design for cutting elements associated with fixed cutter drill bits includes a layer of super hard material or super abrasive material such as a polycrystalline diamond (PDC) layer disposed on a substrate such as tungsten carbide. A wide variety of super hard or super abrasive materials have been used to form such layers on substrates. Such substrates are often formed from cemented tungsten carbide but may be formed from a wide variety of other suitably hard materials. A "super hard layer" or "super abrasive layer" may provide enhanced cutting characteristics and longer downhole drilling life of associated cutting elements.

Backup cutters (sometimes referred to as "secondary cutter") and/or impact arrestors have previously been used on rotary drill bits in combination with cutting elements having super hard or super abrasive layers. Primary cutters are often disposed on fixed cutter drill bits with respective super hard cutting surfaces oriented generally in the direction of bit rotation. Backup cutters and/or impact arrestors are often used when drilling a wellbore in hard subsurface formations or intermediate strength formations with hard stringers. Backup cutters and/or impact arrestors may extend downhole drilling life of an associated rotary drill bit by increasing both surface area and volume of super hard material or super abrasive material in contact with adjacent portions of a downhole formation. For some applications fixed cutter rotary drill bits have been provided with cutting elements having side cutting surfaces in addition to traditional end cutting surfaces.

Some rotary drill bits with primary cutters oriented to engage adjacent portions of a downhole formation along with secondary cutters trailing the primary cutters and typically oriented to act as impact arrestors often require relatively high rates of penetration before the trailing secondary cutters will contact adjacent portions of a downhole formation. For many drilling operations actual rates of penetration may be lower than this required high rate of penetration. As a result, the trailing secondary cutters or impact arrestors may not contact adjacent portions of the downhole formation. For such drilling operations, the secondary cutters may not effectively control rate of penetration and may not protect the primary cutters.

When prior impact arrestors have been placed in a leading position relative to respective cutters, such impact arrestors have often been able to initially control rate of penetration of an associated drill bit. However, when the cutters become worn, rate of penetration for the same overall set of downhole drilling conditions may increase significantly to greater than desired values.

SUMMARY

In accordance with teachings of the present disclosure, rotary drill bits and other downhole tools used to form a wellbore may be provided with cutting elements having respective protectors operable to control depth of a cut formed by each cutting element in adjacent portions of a downhole formation and control rate of penetration of an associated rotary drill bit. For some applications, secondary cutting elements having respective protectors may be combined with primary cutting elements having respective protectors to prolong downhole drilling life of an associated rotary drill bit.

Another aspect of the present disclosure may include substantially reducing and/or eliminating damage to cutting elements while drilling a wellbore in a downhole formation having hard materials. For some applications such cutting elements may have dual cutting surfaces and associated cutting edges. Controlling depth of each cut or kerf formed in adjacent portions of a downhole formation in accordance with teachings of the present disclosure may provide enhanced axial stability and lateral stability during formation of a wellbore. Steerability and tool face controllability of an associated rotary drill bit may also be improved.

Another aspect of the present disclosure includes providing secondary cutters operable to satisfactorily form a wellbore after damage to one or more primary cutters. Separate design and drill bit performance evaluations may be conducted when forming a wellbore with primary cutters and when forming a wellbore with associated secondary cutters.

Technical benefits of the present disclosure may include, but are not limited to, controlling depth of cut of cutting elements disposed on a rotary drill bit, efficiently controlling rate of penetration of the rotary drill bit and/or providing secondary cutting elements operable to prolong downhole drilling life of an associated rotary drill bit. Forming rotary drill bits and associate cutting elements in accordance with teachings of the present disclosure may substantially reduce or eliminate damage to cutting surfaces and/or cutting edges associated with such cutting elements.

Further technical benefits of the present disclosure may include, but are not limited to, eliminating or minimizing impact damage to primary cutters or major cutters, increasing bit life by providing secondary cutters operable to function as primary cutters or major cutters when associated primary cutters experience a designed amount of wear, increased stability of an associated rotary drill bit both axially and radially relative to a bit rotation axis and improving directional drilling control by more efficiently avoiding damage to associated gage cutters.

BRIEF DESCRIPTION OF THE DRAWINGS

A more complete and thorough understanding of various embodiments and advantages thereof may be acquired by referring to the following description taken in conjunction with accompanying drawings, in which like reference numbers indicate like features, and wherein.

DETAILED DESCRIPTION OF THE DISCLOSURE

Figure 1:
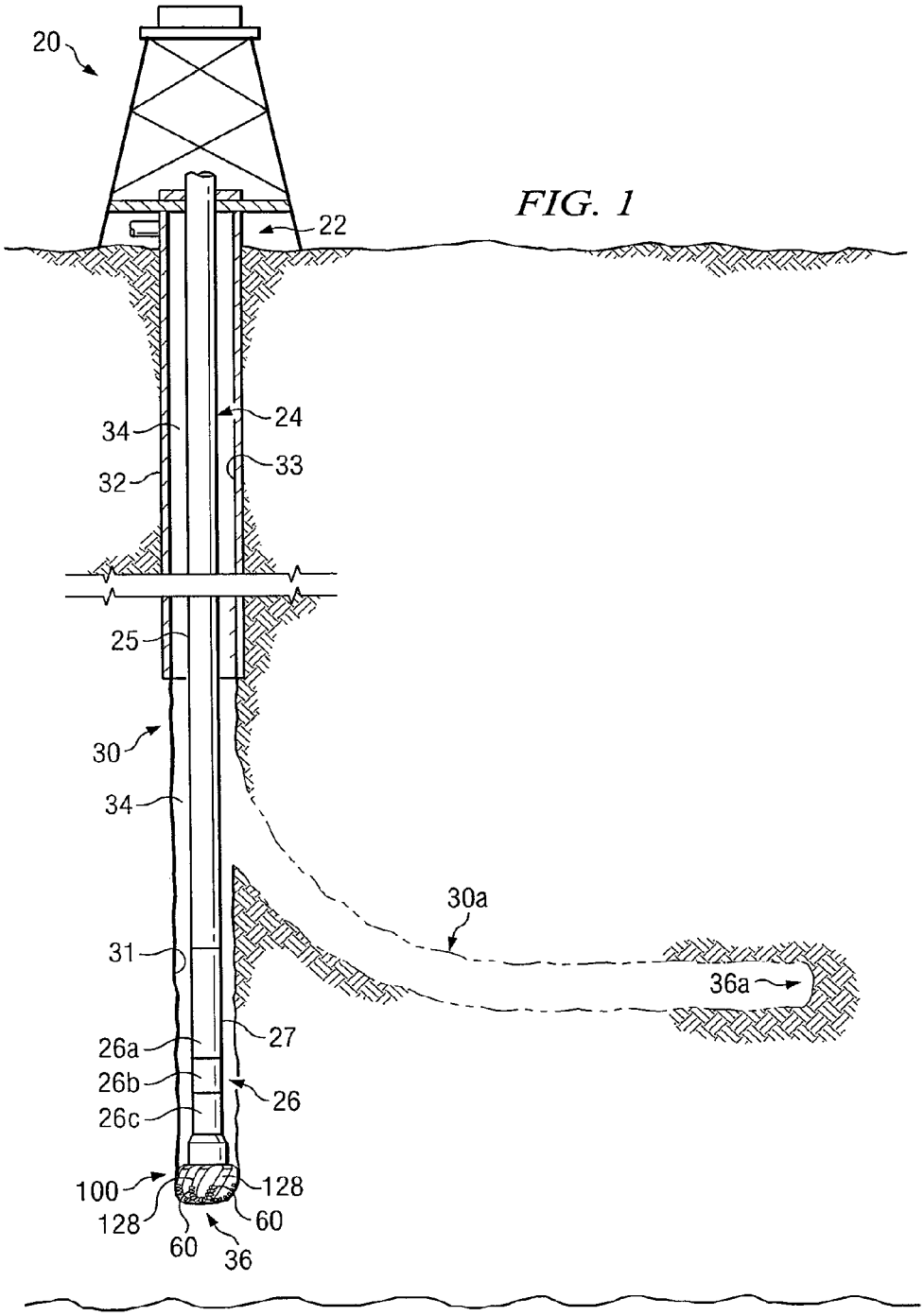
FIG. 1 is a schematic drawing in section and in elevation with portions broken away showing examples of wellbores which may be formed by a rotary drill bit incorporating teachings of the present disclosure.

Preferred embodiments of the present disclosure and various advantages may be understood by referring to FIGS. 1-22B of the drawings. Like numerals may be used for like and corresponding parts in the various drawings.

The terms "rotary drill bit" and "rotary drill bits" may be used in this application to include various types of fixed cutter drill bits, drag bits, matrix drill bits and PDC drill bits. Cutting elements and blades incorporating features of the present disclosure may also be used with reamers, near bit reamers, and other downhole tools associated with forming a wellbore.

Rotary drill bits incorporating teachings of the present disclosure may have many different designs and configurations. Rotary drill bits 100, 100*a* and 100*b* as shown in FIGS. 1, 2, 17, and 21 represent only some examples of rotary drill bits and cutting elements which may be formed in accordance with teachings of the present disclosure.

The terms "cutting element" and "cutting elements" may be used in this application to include various types of compacts, cutters and/or inserts satisfactory for use with a wide variety of rotary drill bits. The term "cutter" may include, but is not limited to, face cutters, gage cutters, inner cutters, shoulder cutters, active gage cutters and passive gage cutters. Such cutting elements may be formed with respective protectors in accordance with teachings of the present disclosure.

Polycrystalline diamond compacts (PDC), PDC cutters and PDC inserts are often used as cutting elements for rotary drill bits. Polycrystalline diamond compacts may also be referred to as PCD compacts. A wide variety of other types of super hard or super abrasive materials may also be used to form portions of cutting elements disposed on a rotary drill bit in accordance with teachings of the present disclosure.

A cutting element or cutter formed in accordance with teachings of the present disclosure may include a substrate with a layer of hard cutting material disposed on one end of the substrate. Substrates associated with cutting elements for rotary drill bits often have a generally cylindrical configuration. However, substrates with noncylindrical and/or noncircular configurations may also be used to form cutting elements in accordance with teachings of the present disclosure.

A wide variety of super hard and/or super abrasive materials may be used to form the layer of hard cutting material disposed on each substrate. Such layers of hard cutting material may have a wide variety of configurations and dimensions. Some examples of these various configurations are shown in the drawings and further described in the written description.

Generally circular cutting surfaces and cutting planes may be described as having an "area" or "cutting area" based on a respective diameter of each cutting surface or cutting plane. For noncircular cutting surfaces and cutting planes an "effective diameter" corresponding with the effective cutting area of such noncircular cutting surfaces and cutting planes may be used to design cutting elements and rotary drill bits in accordance with teachings of the present disclosure.

For some applications cutting elements formed in accordance with teachings of the present invention may include one or more layers of super hard and/or super abrasive materials disposed on a substrate. Such layers may sometimes be referred to as "cutting layers" or "tables". Cutting layers may be formed with a wide variety of configurations, shapes and dimensions in accordance with teachings of the present disclosure. Examples of such configurations and shapes may include, but are not limited to, "cutting surfaces", "cutting edges", "cutting faces" and "cutting sides".

Cutting layers or layers of super hard and/or super abrasive materials may also be referred to as "penetrating layers" or "scraping layers". Some cutting elements incorporating teachings of the present invention may be designed, located and oriented to optimize penetration of an adjacent formation. Other cutting elements incorporating teachings of the present invention may be oriented to optimize scraping adjacent portions of an associated formation. Examples of hard materials which may be satisfactorily used to form cutting layers include various metal alloys and cermets such as metal borides, metal carbides, metal oxides and/or metal nitrides.

The terms "cutting structure" and "cutting structures" may be used in this application to include various combinations and arrangements of cutting elements, cutters, face cutters, gage cutters, impact arrestors, protectors, blades and/or other portions of rotary drill bits, coring bits, reamers and other downhole tools used to form a wellbore. Some fixed cutter drill bits may include one or more blades extending from an associated bit body. Cutting elements are often arranged in rows on exterior portions of a blade or other exterior portions of a bit body associated with fixed cutter drill bits. Various configurations of blades and cutters may be used to form cutting structures for a fixed cutter drill bit in accordance with teachings of the present disclosure.

The term "rotary drill bit" may be used in this application to include, but is not limited to, various types of fixed cutter drill bits, drag bits and matrix drill bits operable to form a wellbore extending through one or more downhole formations. Rotary drill bits and associated components formed in accordance with teachings of the present disclosure may have many different designs and configurations.

The terms "downhole data" and "downhole drilling conditions" may include, but are not limited to, wellbore data and formation data such as listed on Appendix A. The terms "downhole data" and "downhole drilling conditions" may also include, but are not limited to, drilling equipment data such as listed on Appendix A.

The terms "design parameters," "operating parameters," "wellbore parameters" and "formation parameters" may sometimes be used to refer to respective types of data such as listed on Appendix A. The terms "parameter" and "parameters" may be used to describe a range of data or multiple ranges of data. The terms "operating" and "operational" may sometimes be used interchangeably.

Various computer programs and computer models may be used to design cutting elements and associated rotary drill bits in accordance with teachings of the present disclosure. Examples of such methods and systems which may be used to design and evaluate performance of cutting elements and rotary drill bits incorporating teachings of the present disclosure are shown in copending U.S. patent applications entitled "Methods and Systems for Designing and/or Selecting Drilling Equipment Using Predictions of Rotary Drill Bit Walk," application Ser. No. 11/462,898, filing date Aug. 7, 2006, copending U.S. patent application entitled "Methods and Systems of Rotary Drill Bit Steerability Prediction, Rotary Drill Bit Design and Operation," application Ser. No. 11/462,918, filed Aug. 7, 2006, and copending U.S. patent application entitled "Methods and Systems for Design and/or Selection of Drilling Equipment Based on Wellbore Simulations," application Ser. No. 11/462,929, filing date Aug. 7, 2006. The previous copending patent applications and any resulting U.S. patents are incorporated by reference in this application.

The terms "drilling fluid" and "drilling fluids" may be used to describe various liquids and mixtures of liquids and suspended solids associated with well drilling techniques. Drilling fluids may be used for well control by maintaining desired fluid pressure equilibrium within a wellbore and providing chemical stabilization for formation materials adjacent to a wellbore. Drilling fluids may also be used to cool portions of a rotary drill bit and to prevent or minimize corrosion of a drill string, bottom hole assembly and/or attached rotary drill bit.

FIG. 1 is a schematic drawing in elevation and in section with portions broken away showing examples of wellbores or bore holes which may be formed in accordance with teachings of the present disclosure. Various aspects of the present disclosure may be described with respect to drilling rig 20 rotating drill string 24 and attached rotary drill bit 100 to form a wellbore.

Various types of drilling equipment such as a rotary table, mud pumps and mud tanks (not expressly shown) may be located at well surface or well site 22. Drilling rig 20 may have various characteristics and features associated with a "land drilling rig." However, rotary drill bits incorporating teachings of the present disclosure may be satisfactorily used with drilling equipment located on offshore platforms, drill ships, semi-submersibles and drilling barges (not expressly shown).

Rotary drill bit 100, 100*a* and 100*b* (See FIGS. 1, 2, 17 and 21) may be attached to a wide variety of drill strings extending from an associated well surface. For some applications rotary drill bit 100 may be attached to bottom hole assembly 26 at the extreme end of drill string 24. Drill string 24 may be formed from sections or joints of generally hollow, tubular drill pipe (not expressly shown). Bottom hole assembly 26 will generally have an outside diameter compatible with exterior portions of drill string 24.

Bottom hole assembly 26 may be formed from a wide variety of components. For example components 26*a*, 26*b* and 26*c* may be selected from the group consisting of, but not limited to, drill collars, rotary steering tools, directional drilling tools and/or downhole drilling motors. The number of components such as drill collars and different types of components included in a bottom hole assembly will depend upon anticipated downhole drilling conditions and the type of wellbore which will be formed by drill string 24 and rotary drill bit 100.

Drill string 24 and rotary drill bit 100 may be used to form a wide variety of wellbores and/or bore holes such as generally vertical wellbore 30 and/or generally horizontal wellbore 30*a* as shown in FIG. 1. Various directional drilling techniques and associated components of bottomhole assembly 26 may be used to form horizontal wellbore 30*a*.

Wellbore 30 may be defined in part by casing string 32 extending from well surface 22 to a selected downhole location. Portions of wellbore 30 as shown in FIG. 1 which do not include casing 32 may be described as "open hole". Various types of drilling fluid may be pumped from well surface 22 through drill string 24 to attached rotary drill bit 100. The drilling fluid may be circulated back to well surface 22 through annulus 34 defined in part by outside diameter 25 of drill string 24 and inside diameter 31 of wellbore 30. Inside diameter 31 may also be referred to as the "sidewall" of wellbore 30. Annulus 34 may also be defined by outside diameter 25 of drill string 24 and inside diameter 31 of casing string 32.

Formation cuttings may be formed by rotary drill bit 100 engaging formation materials proximate end 36 of wellbore 30. Drilling fluids may be used to remove formation cuttings and other downhole debris (not expressly shown) from end 36 of wellbore 30 to well surface 22. End 36 may sometimes be described as "bottom hole" 36. Formation cuttings may also be formed by rotary drill bit 100 engaging end 36*a* of horizontal wellbore 30*a*.

As shown in FIG. 1, drill string 24 may apply weight to and rotate rotary drill bit 100 to form wellbore 30. Inside diameter or sidewall 31 of wellbore 30 may correspond approximately with the combined outside diameter of blades 128 extending from rotary drill bit 100. Rate of penetration (ROP) of a rotary drill bit is typically a function of both weight on bit (WOB) and revolutions per minute (RPM). For some applications a downhole motor (not expressly shown) may be provided as part of bottom hole assembly 90 to also rotate rotary drill bit 100. The rate of penetration of a rotary drill bit is generally stated in feet per hour.

In addition to rotating and applying weight to rotary drill bit 100, drill string 24 may provide a conduit for communicating drilling fluids and other fluids from well surface 22 to drill bit 100 at end 36 of wellbore 30. Such drilling fluids may be directed to flow from drill string 24 to respective nozzles 56 provided in rotary drill bit 100. See FIG. 2.

Bit body 120 will often be substantially covered by a mixture of drilling fluid, formation cuttings and other downhole debris while drilling string 24 rotates rotary drill bit 100. Drilling fluid exiting from one or more nozzles 56 may be directed to flow generally downwardly between adjacent blades 128 and flow under and around lower portions of bit body 120.

Figure 2:
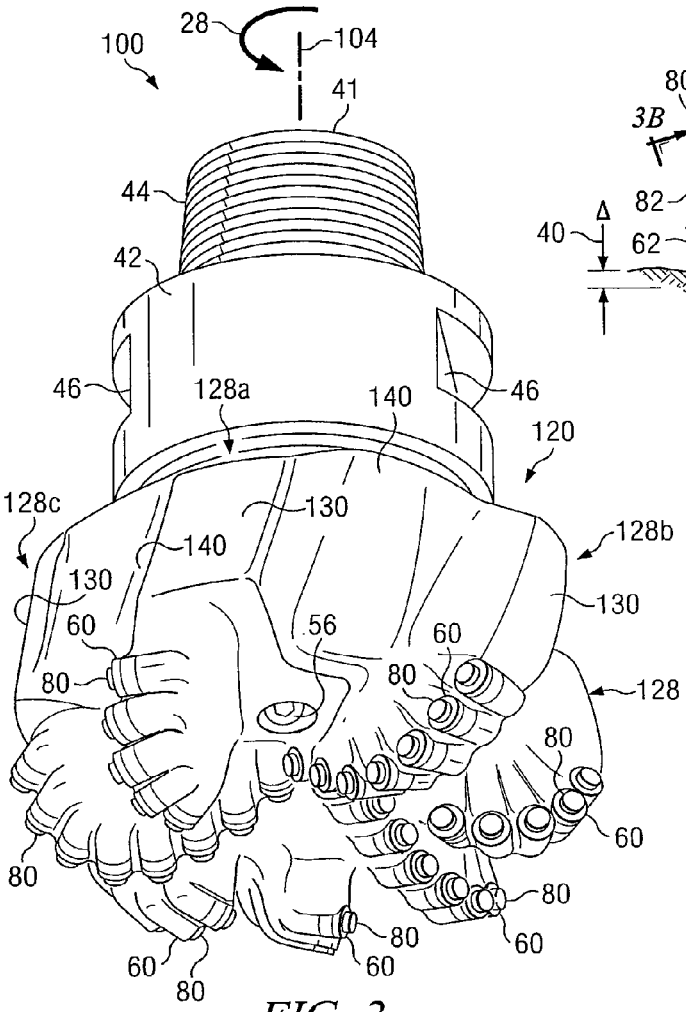
FIG. 2 is a schematic drawing showing an isometric view of one example of a rotary drill bit incorporating teachings of the present disclosure.

FIG. 2 is a schematic drawing showing a rotary drill bit with a plurality of cutting elements incorporating teachings of the present disclosure. Rotary drill bit 100 may include bit body 120 with a plurality of blades 128 extending therefrom. For some applications bit bodies 120, 120*a* (see FIG. 17) and 120*b* (see FIG. 21A) may be formed in part from a matrix of very hard materials associated with rotary drill bits. For other applications bit body 120, 120*a* and 120*b* may be machined from various metal alloys satisfactory for use in drilling wellbores in downhole formations. Examples of matrix type drill bits are shown in U.S. Pat. Nos. 4,696,354 and 5,099,929.

Bit body 120 may also include upper portion or shank 42 with American Petroleum Institute (API) drill pipe threads 44 formed thereon. API threads 44 may be used to releasably engage rotary drill bit 100 with bottomhole assembly 26 whereby rotary drill bit 100 may be rotated relative to bit rotational axis 104 in response to rotation of drill string 24. Bit breaker slots 46 may also be formed on exterior portions of upper portion or shank 42 for use in engaging and disengaging rotary drill bit 100 from an associated drill string.

A longitudinal bore (not expressly shown) may extend from end 41 through upper portion 42 and into bit body 120. The longitudinal bore may be used to communicate drilling fluids from drill string 32 to one or more nozzles 56.

A plurality of respective junk slots or fluid flow paths 140 may be formed between respective pairs of blades 128. Blades 128 (see FIG. 2), 128*a* (see FIG. 17) and 128*b* (see FIG. 21A) may spiral or extend at an angle relative to associated bit rotational axis 104, 104*a* and 104*b*. One of the benefits of the present disclosure includes designing cutting elements and/or associated protectors based on parameters such as blade length, blade width, blade spiral and/or other parameters associated with rotary drill bits as shown in Schedule A.

A plurality of cutting elements 60 may be disposed on exterior portions of each blade 128. For some applications each cutting element 60 may be disposed in a respective socket or pocket formed on exterior portions of associated blade 128. Various parameters associated with rotary drill bit 100 may include, but are not limited to, location and configuration of blades 128, junk slots 140 and cutting elements 60. Such parameters may be designed in accordance with teachings of the present disclosure for optimum performance of rotary drill bit 100 in forming a wellbore.

Each blade 128 may include respective gage surface or gage portion 130. For some applications active and/or passive gage cutters may also be disposed on each blade 128. See for example, FIG. 21A. For other applications impact arrestors and/or secondary cutters may also be disposed on each blade 128. See for example, FIG. 17. Additional information concerning gage cutters and hard cutting materials may be found in U.S. Pat. Nos. 7,083,010, 6,845,828, and 6,302,224. Additional information concerning impact arrestors may be found in U.S. Pat. Nos. 6,003,623, 5,595,252 and 4,889,017.

Rotary drill bits are generally rotated to the right during formation of a wellbore. See arrow 28 in FIGS. 2, 17, 18B and 21A. Therefore, cutting elements and/or blades may be generally described as "leading" or "trailing" with respect to other cutting elements and/or blades disposed on the exterior portions of the rotary drill bit. For example blade 128*a* as shown in FIG. 2 may be generally described as leading blade 128*b* and may be described as trailing blade 128*c*. In the same respect cutting element 60 disposed on blade 128*a* may be described as leading corresponding cutting element 60 disposed on blade 128*b*. Cutting elements 160 disposed on blade 180*a* may be generally described as trailing cutting element 60 disposed on blade 128*c*.

During rotation of an associated fixed cutter rotary drill, cutting element 60 will generally cut or form kerf 39 in adjacent portions of downhole formation 38. The dimensions and configuration of kerf 39 typically depend on factors such as dimensions and configuration of primary cutting surface 71, rate of penetration of the associated rotary drill bit, radial distance of cutting element 60 from an associated bit rotational axis, type of downhole formation materials (soft, medium, hard, hard stringers, etc.) and amount of formation material removed by a leading cutting element. For cutting elements disposed on a fixed cutter rotary drill bit, rate of penetration, weight on bit, total number of cutting elements, size of each cutting element, and respective radial position of each cutting element will determine an average kerf depth or cutting depth for each cutting element.

Figure 3A:
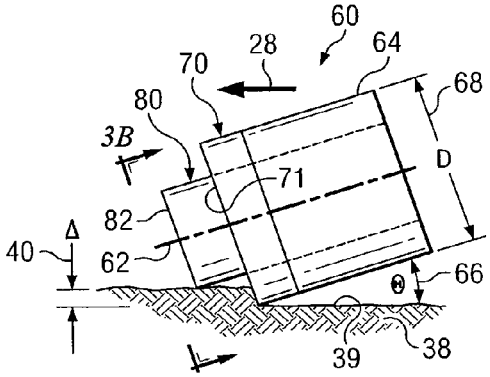
FIG. 3A is a schematic drawing showing a side view of a cutting element incorporating teachings of the present disclosure in contact with adjacent portions of a downhole formation.
Figure 3B:
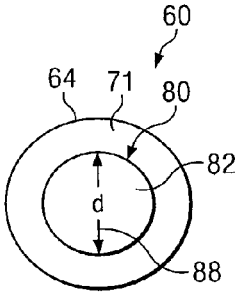
FIG. 3B is a schematic drawing taken along lines 3B-3B of FIG. 3A.
Figure 3C:
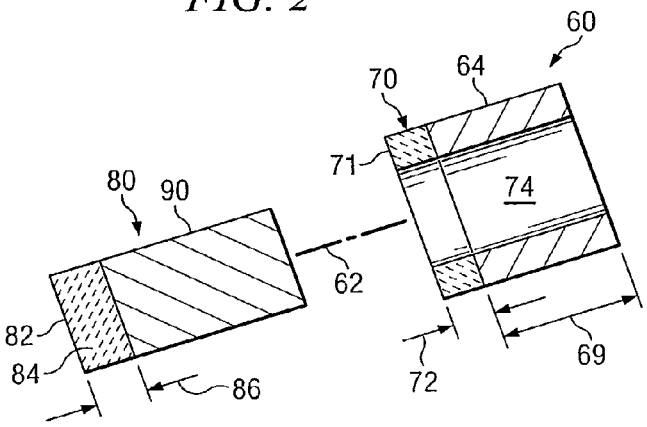
FIG. 3C is a schematic drawing in section showing an exploded view of the cutting element in FIG. 3A.
Figure 19:
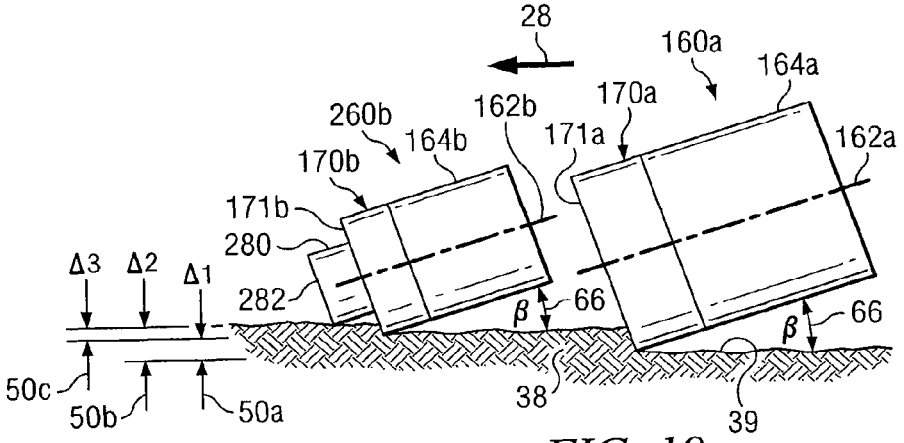
FIG. 19 is a schematic drawing with portions broken away showing a primary cutting element and associated secondary cutting element incorporating teachings of the present disclosure engaged with adjacent portions of a downhole formation.
Figure 22A:
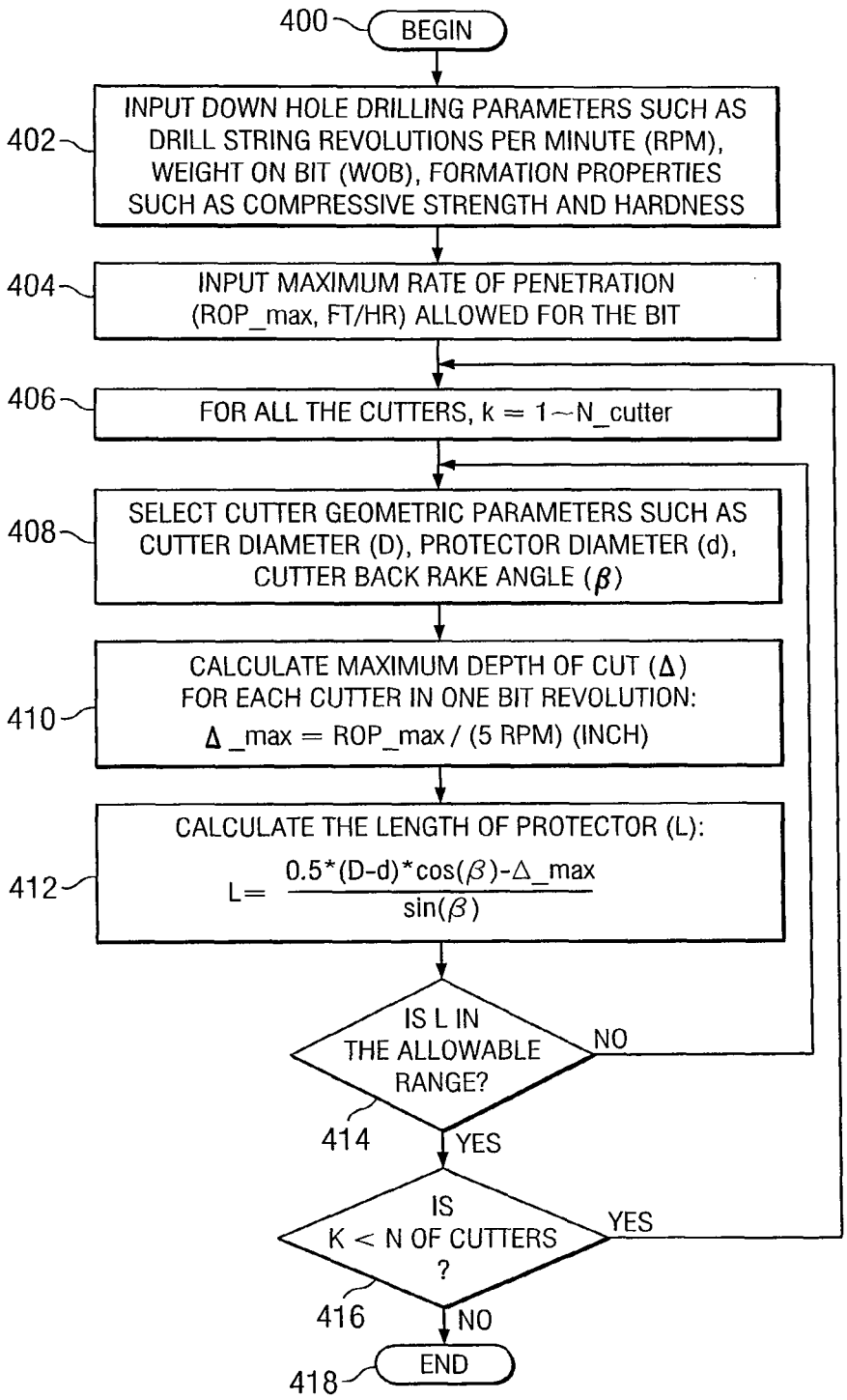
FIG. 22A is a block diagram showing one method of designing cutting elements, associated protectors and an associated rotary drill bit to limit depth of a cut or kerf formed by each cutting element in accordance with teachings of the present disclosure.
Figure 22B:
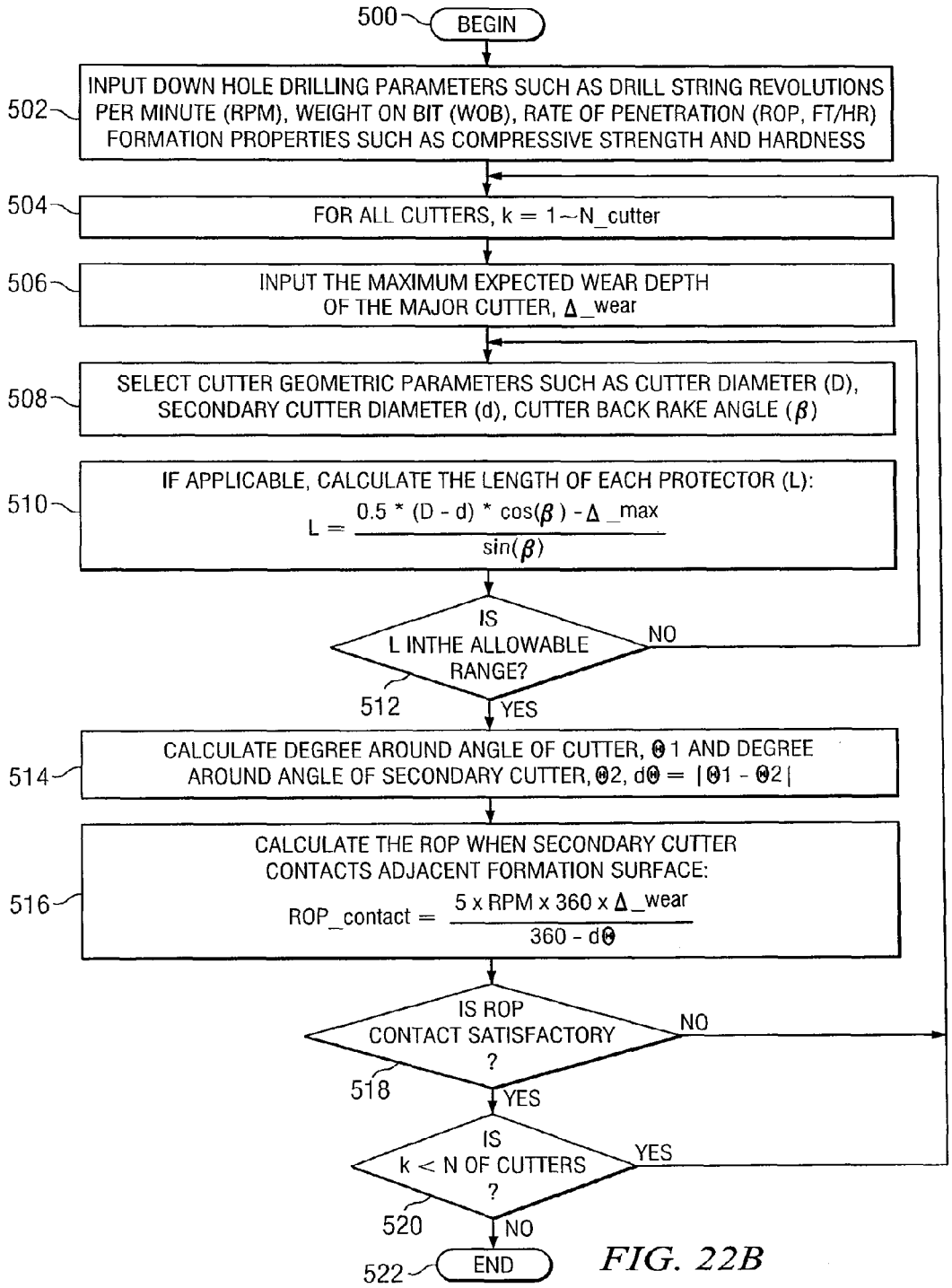
FIG. 22B is a block diagram showing one method of designing primary cutting elements, associated secondary cutting elements, protectors when included on one or more primary cutting elements and/or secondary cutting elements and an associated rotary drill bit whereby the secondary cutting elements may extend downhole drilling life of the associated rotary drill bit in accordance with teachings of the present disclosure.

Cutting elements such as shown in FIGS. 3A-16 may be formed with respective protectors designed to function as depth limiters or impact arrestors (see FIG. 22A) or may be designed to function as secondary cutters (see FIGS. 19 and 22B). For embodiments such as shown in FIGS. 3A, 3B and 3C cutting element 60 may include protector 80 extending from primary cutting surface 71. Various characteristics and features of cutting element 60 may be described with respect to central axis 62. Cutting element 60 may include substrate 64 with layer 70 of hard cutting material disposed on one end of substrate 64. Layer 70 of hard cutting material may also be referred to as "cutting layer 70." Substrate 64 may have various configurations relative to central axis 62. Substrate 64 may be formed from tungsten carbide or other materials associated with forming cutting elements for rotary drill bits.

Layer 84 of hard cutting material may be disposed on one end of protector 80 spaced from primary cutting surface 71. Layer 84 of hard cutting material may also be referred to as "cutting layer 84." For some applications cutting layers 70 and 84 may be formed from substantially the same hard cutting materials. For other applications cutting layers 70 and 84 may be formed from different materials. Protector 80 may also include cutting surface 82 formed on an extreme end of protector 80 opposite from substrate 64.

Each cutting element 60 may be disposed on exterior portions of an associated rotary drill bit such as blades 128 of rotary drill bit 100. The orientation of each cutting element 60 may be selected to provide desired angle 66 at which primary cutting surface 71 engages adjacent portions of downhole formation 38. Angle 66 may sometimes be referred to as a "backrake angle" or the angle at which primary cutting surface 71 engages adjacent portions of formation 38. See FIG. 3A. For some applications backrake angle 66 may be selected to be between approximately ten degrees (10°) and thirty degrees (30°) based on anticipated downhole drilling conditions and various characteristics of an associated rotary drill bit. See Appendix A.

For embodiments such as shown in FIGS. 3A, 3B and 3C substrate 64 may have a generally cylindrical configuration defined in part by diameter 68. See FIG. 3A. Protector 80 may also have a generally cylindrical configuration defined in part by diameter 88. See FIG. 3B. The overall length of cutting element 60 may be equal to length 69 of substrate 60 plus thickness 72 of cutting layer 70 and length 86 of the portion of protector 80 extending from primary cutting surface 71. See FIG. 3C.

Various geometric parameters associated with a cutting element and associated protector incorporating teachings of the present disclosure may be calculated based on the following equation.

$$\Delta=0.5(D-d)\cos(\beta)-L\sin(\beta)$$

Where Δ=designed depth of cut or maximum depth of cut by a primary cutting surface of a cutting element during one bit revolution before an associated protector contacts adjacent portions of a downhole formation. A cutting surface may also be provided the associated protector for purpose of contacting adjacent portions of the downhole formation.

D=diameter of the cutting element d=diameter of the protector

β=backrake angle of the cutting element

L=length of the protector extending from the primary cutting surface of the cutting element.

Rotary drill bits typically have a designed maximum rate of penetration based on parameters such as weight on bit (WOB), revolutions per minute (RPM) and associated downhole formation characteristics. See Appendix A. A corresponding maximum depth of cut ($\Delta_{max}$) for each cutting element during one bit revolution may be calculated using the formula:

$$\Delta_{max} = \frac{ROP_{max}}{5 \times \text{RPM}}$$

For some applications maximum depth of cut ($\Delta_{max}$) may correspond with a designed depth of cut ($\Delta$) for each cutting element. For other applications the designed depth of cut ($\Delta$) may be calculated using a rate of penetration other than $ROP_{max}$. For example, an optimum rate of penetration may be used to calculate a designed depth of cut ($\Delta$) based on anticipated downhole formation characteristics.

Length 86 of protector 80 may be designed to allow primary cutting surface 71 to form kerf or track 39 in adjacent portions of formation 38 with depth of cut ($\Delta$) 40 prior to cutting surface 82 of protector 80 engaging adjacent portions of formation 38. See FIG. 3A. Various techniques associated with designing cutting elements, protectors and associated rotary drill bits will be discussed later in more detail with respect to FIGS. 21A, 21B, 22A and 22B.

For embodiments such as shown in FIGS. 3A, 3B and 3C substrate 64 may be initially formed as a generally solid cylinder using conventional techniques associated with forming cutting elements for a rotary drill bit. Cutting layer 70 may be disposed on one end of substrate 64 using conventional manufacturing techniques associated with forming a cutting element for a rotary drill bit. Various techniques such as laser cutting procedures may then be used to form central bore 74 extending along central axis 62. See FIG. 3C.

For some applications EDM (electric discharge machining) techniques may also be used to form a central bore extending along a central axis of a substrate. For example a hole or other opening (not expressly shown) may be formed proximate a midpoint in the side of a generally solid cylinder having overall dimensions associated with substrate 64. An EDM wire (not expressly shown) may be inserted through the hole to form central bore 74.

For some applications protector 80 may include substrate 90 having exterior dimensions and configuration compatible with the dimensions and configuration of central bore 74. Layer 84 of hard cutting material may be disposed on one end of substrate 90 using conventional cutting element manufacturing techniques. The dimensions of substrate 90 may be selected such that substantially the full length 86 cutting layer 84 will extend from primary cutting surface 71. Various techniques associated with forming polycrystalline diamond components may be used to securely engage substrate 90 within central bore 74.

Figure 3D:
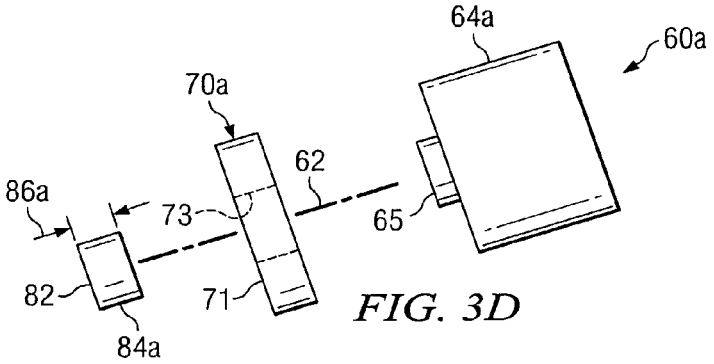
FIG. 3D is a schematic drawing in section showing an exploded view of an alternative embodiment of a cutting element such as shown in FIG. 3A.

FIG. 3D shows one example of an alternative procedure which may be satisfactorily used to form a cutting element and associated protector in accordance with teachings of the present disclosure. For such embodiments, cutting element 60*a* may include substrate 64*a* with projection or post 65 extending from one end thereof. Cutting layer 70*a* may be formed with hole or cutout 73 disposed therein and extending therethrough. Hole 73 may be compatible with exterior portions of projection 65 extending from substrate 64*a*. Hole 73 of cutting layer 70*a* may then be disposed over projection 65. Adjacent portions of cutting layer 70*a* may be bonded with one end of substrate 64 using conventional techniques associated with manufacturing cutting elements for rotary drill bits.

Cutting layer 84*a* may be formed with dimensions compatible with opening 73 in layer 70*a* and with the extreme end of projection 65. Thickness 86*a* of cutting layer 84*a* may be selected to allow cutting surface 82 of cutting layer 84*a* to extend a desired length from primary cutting surface 71.

Figure 3E:
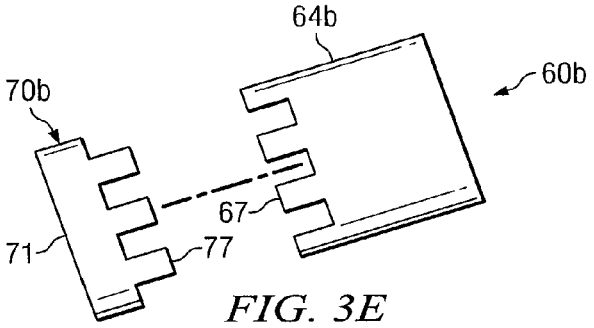
FIG. 3E is a schematic drawing in section showing an exploded view of an alternative technique of forming a layer of hard cutting material on a substrate.

FIG. 3E is a schematic drawing showing one technique to attach cutting layer 70*b* with one end of substrate 64*b* using interlocking connections 67 and 77. The dimensions and configurations of interlocking connections 67 and 77 have been exaggerated in FIG. 3E for purposes of illustration. Also, a wide variety of interlocking connections and other techniques may be satisfactorily used to attach a cutting layer with one end of a substrate.

Figure 4A:
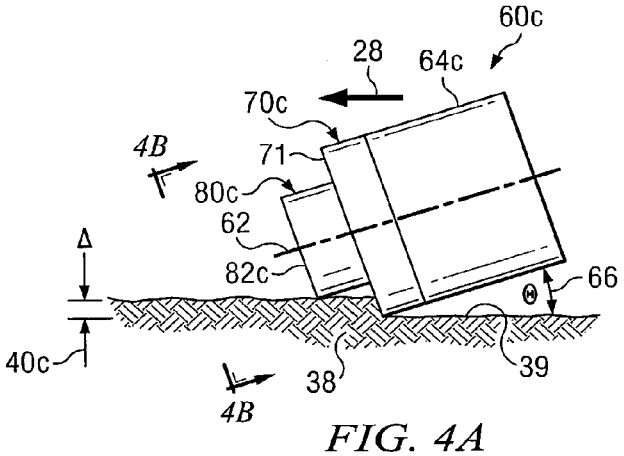
FIG. 4A is a schematic drawing showing a side view of a cutting element incorporating teachings of the present disclosure in contact with adjacent portions of a downhole formation.
Figure 4B:
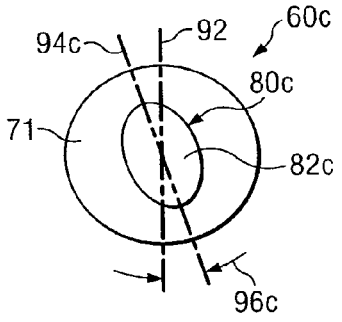
FIG. 4B is a schematic drawing taken along lines 4B-4B of FIG. 4A.

FIGS. 4A and 4B show an alternative embodiment of a cutting element formed in accordance with teachings of the present disclosure. Cutting element 60*c* may include substrate 64*c* having a configuration as previously described with respect to substrate 64. Cutting layer 70*c* may be disposed on one end of substrate 64*c* with protector 80*c* extending from primary cutting surface 71. For embodiments such as shown in FIGS. 4A and 4B, protector 80*c* may have a generally elliptical or oval shaped configuration. See FIG. 4B.

Various features of a cutting element formed in accordance with teachings of the present disclosure may be described with respect to a cutting face axis. In a cutting element coordinate system the cutting face axis may extend from a point of contact between an associated cutting surface and adjacent portions of the downhole formation through the center of the cutting surface. The cutting face axis may also extend generally normal to a central axis of an associated substrate. One example is cutting face axis 92 as shown in FIG. 4B.

The generally elliptical or oval shaped configuration of protector 80*c* may be defined in part by primary axis or major axis 94*c*. For embodiments such as shown in FIGS. 4A and 4B, protector 80*c* may be aligned with relatively small angle 96*c* formed between cutting face axis 92 of cutting element 60*c* and major axis 94 of protector 80*c*. As a result, designed cutting depth ($\Delta$) 40*c* or the cutting depth when cutting surface 82*c* of protector 80*c* may contact adjacent portions of formation 38 may be relatively small.

Figure 5A:
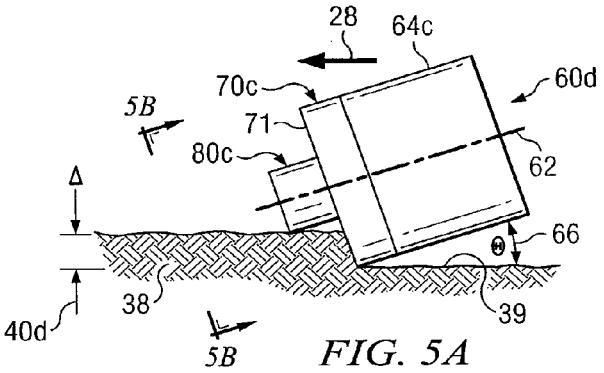
FIG. 5A is a schematic drawing showing a side view of a cutting element incorporating teachings of the present disclosure in contact with adjacent portions of a downhole formation.
Figure 5B:
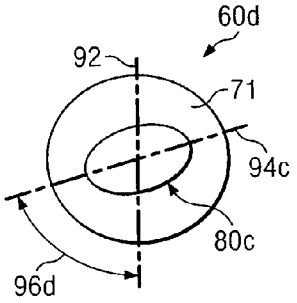
FIG. 5B is a schematic drawing taken along lines 5B-5B of FIG. 5A.

Cutting element 60*d* as shown in FIGS. 5A and 5B may include previously described substrate 64*c*, cutting layer 70*c* and protector 80*c*. However, for embodiments of the present disclosure as represented by cutting element 60*d*, major axis 94*c* of protector 80*c* may be oriented to form a relatively large angle 96*d* between primary cutting face axis 92 and major axis 94*c* of protector 80*c*. As a result, designed cutting depth 40*d* associated with cutting element 60*d* may be substantially larger than designed cutting depth 40*c* associated with cutting element 60*c*.

One of the benefits of the present disclosure includes the ability to orient or rotate protector 80*c* prior to attachment with an associated substrate to vary the angle between major axis 94 and cutting face axis 92 of an associated cutting element to control the cutting depth of the cutting element. The smallest designed cutting depth ($\Delta$) 40*c* may occur when major axis 94 is aligned generally parallel with cutting face axis 92. The largest design cutting depth ($\Delta$) 40*c* may occur at major axis 94 aligned generally perpendicular with cutting face axis 92.

Figure 6A:
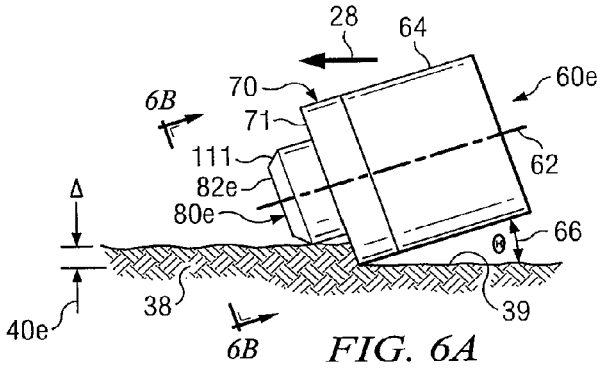
FIG. 6A is a schematic drawing showing a side view of another cutting element incorporating teachings of the present disclosure in contact with adjacent portions of a downhole formation.
Figure 6B:
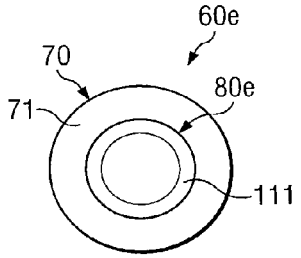
FIG. 6B is a schematic drawing taken along lines 6B-6B of FIG. 6A.

FIGS. 6A and 6B show another embodiment of a cutting element formed in accordance with teachings of the present disclosure. Cutting element 60*e* may include previously described substrate 64 in combination with cutting layer 70 and protector 80*e*. For such embodiments first beveled surface 111 may be formed on exterior portions of cutting surface 82*e*. The dimensions and configuration of first beveled surface 111 may be selected to reduce associated cutting depth ($\Delta$) 40*e* as compared to cutting depth 40 of cutting element 60 if protector 80 and 80*e* have approximately the same overall length.

Figure 7A:
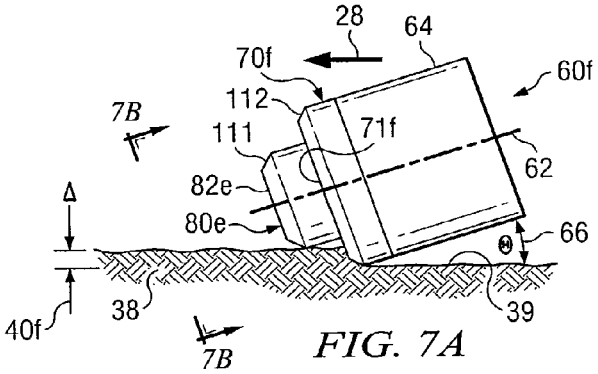
FIG. 7A is a schematic drawing showing a side view of still another cutting element incorporating teachings of the present disclosure in contact with adjacent portions of a downhole formation.
Figure 7B:
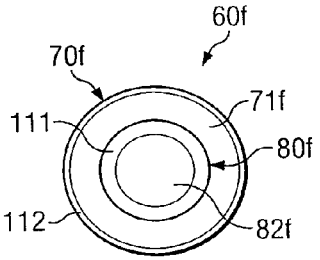
FIG. 7B is a schematic drawing taken along lines 7B-7B of FIG. 7A.

FIGS. 7A and 7B show still another embodiment of a cutting element formed in accordance with teachings of the present disclosure. Cutting element 60*f* may include previously described substrate 64 in combination with cutting layer 70*f* and protector 80*e*. For embodiments represented by cutting element 60*f*, second beveled surface 112 may be formed on exterior portions of cutting layer 70*f* adjacent to cutting surface 71*f*. The dimensions and configuration of second beveled surface 112 may be selected to reduce associated cutting depth (Δ) 40*f* as compared to cutting depth 40*e* of cutting element 60*e*. Beveled surfaces 111 and 112 may substantially increase the downhole drilling life of associated cutting element 60*f* by reducing wear of associated cutting surfaces 82*e* and 71*f*. Designed cutting depth 40*f* of cutting element 60*f* may be less than or shorter than designed cutting depth 40*e* of cutter 60*e*.

Figure 8A:
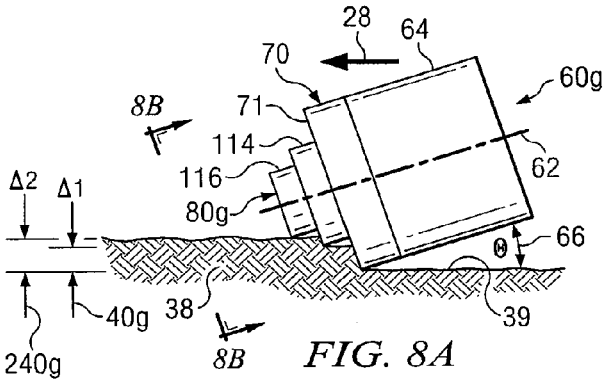
FIG. 8A is a schematic drawing showing a side view of a cutting element incorporating teachings of the present disclosure in contact with adjacent portions of a downhole formation.
Figure 8B:
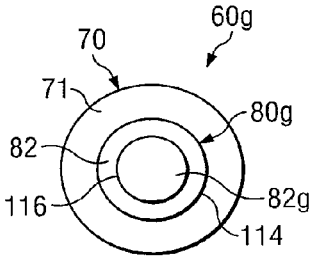
FIG. 8B is a schematic drawing taken along lines 8B-8B of FIG. 8A.

FIGS. 8A and 8B show another example of a cutting element formed in accordance with teachings of the present disclosure. Cutting element 60*g* may be formed with previously described substrate 64 and cutting layer 70. However, protector 80*g* may have a generally "stepped" configuration defined in part by first portion 114 and second portions 116. The diameter of first portion 114 may be approximately equal to the diameter of previously described protector 80. The diameter of second portion 116 may be reduced as compared to first portion 114. As a result, protector 80*f* may have first designed cutting depth ($\Delta_1$) 40*g* and second designed cutting depth ($\Delta_2$) 240*g*. Cooperation between the cutting depths associated with first segment 114 and second segment 116 may result in protector 80*g* substantially increasing the life of associated cutting element 60*g* and an associated rotary drill bit.

Figure 9A:
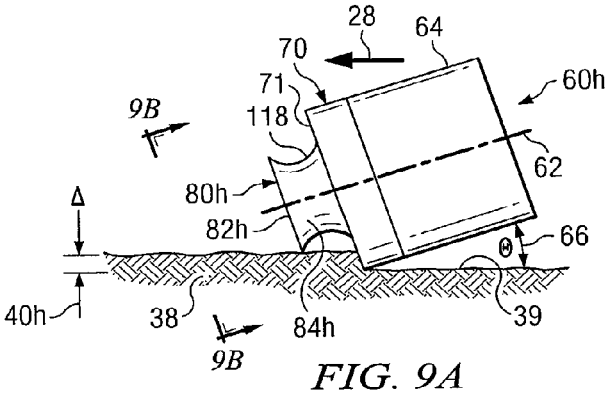
FIG. 9A is a schematic drawing showing a side view of a cutting element incorporating teachings of the present disclosure in contact with adjacent portions of a downhole formation.
Figure 9B:
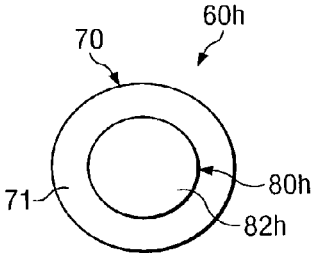
FIG. 9B is a schematic drawing taken along lines 9B-9B of FIG. 9A.

FIGS. 9A and 9B show still another embodiment of a cutting element formed in accordance with teachings of the present disclosure. Cutting element 60*h* may include previously described substrate 64 and cutting layer 70 disposed on one end thereof. Protector 80*h* may include associated cutting layer 84*h* having a modified exterior configuration. For embodiments such as shown in FIGS. 9A and 9B, radius or annular groove 118 may be formed in between cutting surface 82*h* and primary cutting surface 71. As a result, wear characteristics of cutting surface 82*h* and cutting layer 84*h* may be modified.

Figure 10A:
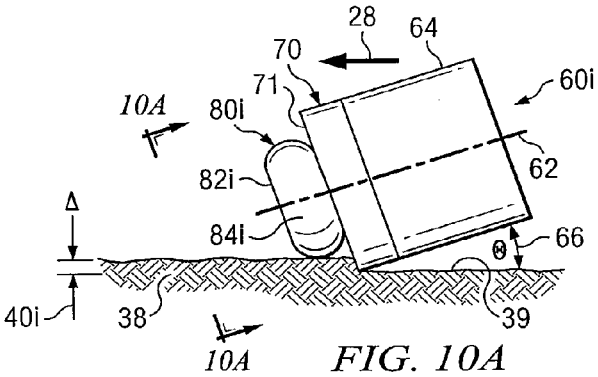
FIG. 10A is a schematic drawing showing a side view of a cutting element incorporating teachings of the present disclosure in contact with adjacent portions of a downhole formation.
Figure 10B:
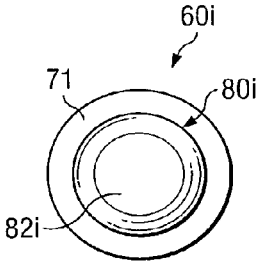
FIG. 10B is a schematic drawing taken along lines 10B-10B of FIG. 10A.

FIGS. 10A and 10B show a further embodiment of a cutting element formed in accordance with teachings of the present disclosure. Cutting element 60*i* as shown in FIGS. 10A and 10B may include substrate 64 with cutting layer 70 disposed on one end thereof. Protector 80*i* may include associated cutting layer 84*i* having a modified exterior configuration. For embodiments such as shown in FIGS. 10A and 10B exterior portions of cutting layer 84*i* may be generally described as forming a torus extending between cutting surface 82*i* and primary cutting surface 71. The exterior configuration of protector 80*i* may be modified to vary cutting depth (Δ) 40*i* and/or to minimize wear of protector 80*i* during contact with adjacent portions of downhole formation 38.

Figure 11A:
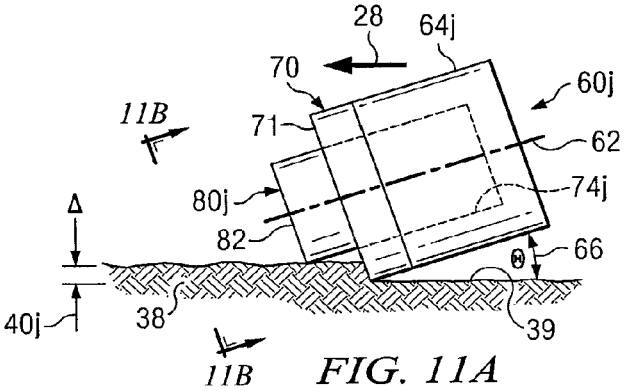
FIG. 11A is a schematic drawing showing a side view of a cutting element incorporating teachings of the present disclosure in contact with adjacent portions of a downhole formation.
Figure 11B:
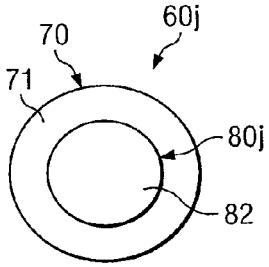
FIG. 11B is a schematic drawing taken along lines 11B-11B of FIG. 11A.

FIGS. 11A and 11B show another example of a cutting element formed in accordance with teachings of the present disclosure. For embodiments represented by cutting element 60*j*, cavity or void space 74*j* may be formed in substrate 64*j* extending partially therethrough. Protector 80*j* may have a similar configuration with respect to previously described protector 80. However, the overall length of protector 80*j* may be reduced to accommodate the depth of cavity 74*j*. The designed cutting depth for cutting element 60*j* may be substantially the same as the design cutting depth for cutting element 60 depending on the length of protector 80*j* extending from primary cutting surface 71.

Figure 12A:
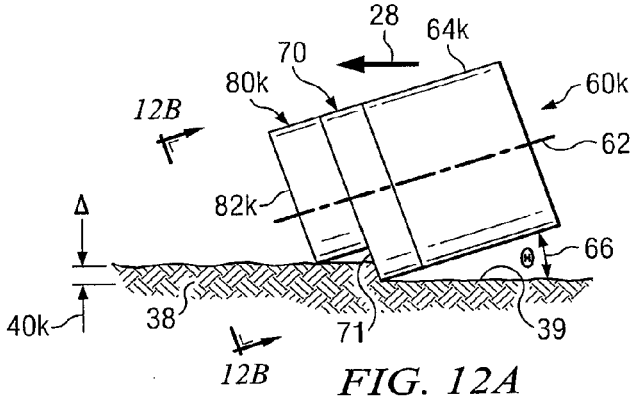
FIG. 12A is a schematic drawing showing a side view of a cutting element incorporating teachings of the present disclosure in contact with adjacent portions of a downhole formation.
Figure 12B:
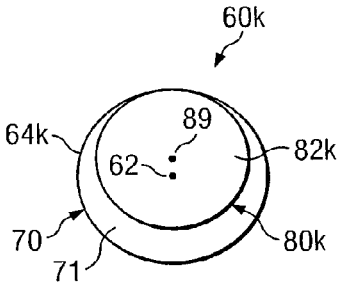
FIG. 12B is a schematic drawing taken along lines 12B-12B of FIG. 12A.

FIGS. 12A and 12B show a further embodiment of a cutting element formed in accordance with teachings of the present disclosure. For embodiments represented by cutting element 60*k*, substrate 64*k* may have cutting layer 70 disposed on one end thereof similar to previously described cutting element 60. Protector 80*k* may be disposed on and extend from primary cutting surface 71. However, center 89 of cutting surface 82*k* of protector 80*k* may be offset from central axis 62 of substrate 64*k*. See FIG. 12B.

For embodiments represented by cutting element 60*k* as shown in FIGS. 12A and 12B, the location of a protector on an associated primary cutting surface may be varied to modify the associated designed cutting depth (Δ). Alternatively, the location of a protector on a primary cutting surface may be modified and the dimensions and/or configurations of the protector may be increased such that the resulting cutting depth is approximately the same. For example, protector 80*k* may have larger diameter (d) 88 as compared with protector 80 which may allow for an extended downhole drilling life with respect to cutting element 60*k* when cutting surface 82*k* becomes the primary cutting surface. For such embodiments, designed cutting depth (Δ) 40*k* may be approximately equal to designed cutting depth (Δ) 40 associated with cutting element 60.

Figure 13A:
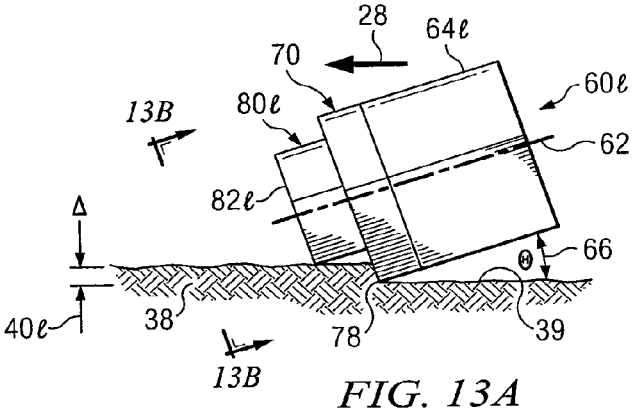
FIG. 13A is a schematic drawing showing a side view of a cutting element incorporating teachings of the present disclosure in contact with adjacent portions of a downhole formation.
Figure 13B:
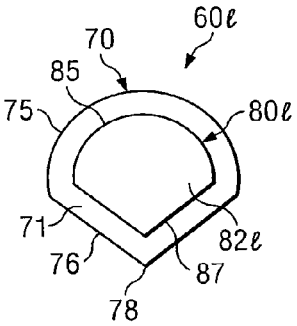
FIG. 13B is a schematic drawing taken along lines 13B-13B of FIG. 13A.

FIGS. 13A and 13B show a further embodiment of a cutting element formed in accordance with teachings of the present disclosure. Cutting element 60*l* may include substrate 64*l* having a configuration similar to a "scribe". Various types of cutting elements having the configuration of a scribe have been previously used with rotary drill bits. Substrate 64*l* may be generally described as having a cross section defined in part by semicircular portion 75 with triangular portion 76 extending therefrom. One of the characteristics of a scribe type cutting element may include relatively sharp cutting tip or cutting edge 78. See FIG. 13B.

For embodiments such as shown in FIGS. 13A and 13B, protector 80*l* may also have a generally scribe shaped configuration defined in part by semicircular portion 85 and triangular portion 87. For some applications cutting element 60*l* may be disposed in an associated rotary drill bit such that cutting tip or cutting edge 78 will initially contact adjacent portions of downhole formation 38. See FIG. 13A.

Figure 14A:
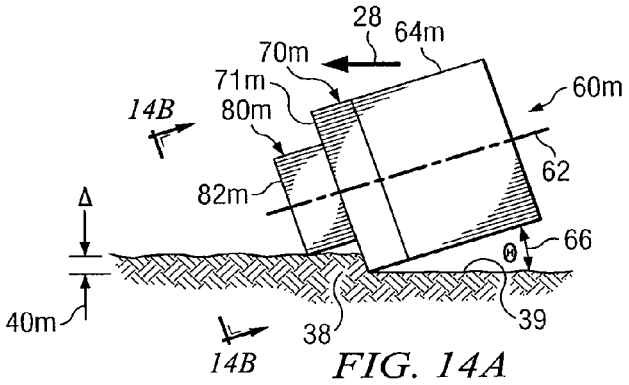
FIG. 14A is a schematic drawing showing a side view of a cutting element incorporating teachings of the present disclosure in contact with adjacent portions of a downhole formation.
Figure 14B:
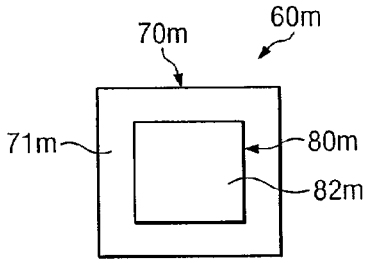
FIG. 14B is a schematic drawing taken along lines 14B-14B of FIG. 14A.
Figure 14C:
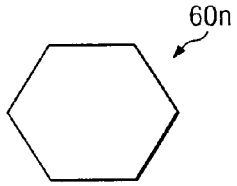
FIG. 14C is a schematic drawing showing an alternative configuration for a cutting element shown in FIG. 14A.
Figure 14D:
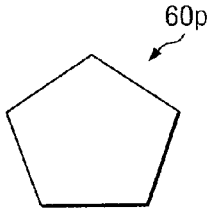
FIG. 14D is a schematic drawing showing an alternative configuration for a cutting element shown in FIG. 14A.
Figure 14E:
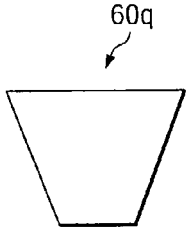
FIG. 14E is a schematic drawing showing an alternative configuration for a cutting element shown in FIG. 14A.

FIGS. 14A and 14B show one example of a cutting element formed in accordance with teachings of the present disclosure. Cutting element 60*m* may include substrate 64 having a generally square cross section. Cutting layer 70*m* and primary cutting surface 71*m* may also have corresponding square cross sections. See FIG. 14B.

Protector 80*m* may extend from primary cutting surface 71*m* as previously described with respect to cutting element 60. Protector 80*m* may have a generally square cross section smaller than the cross section of primary cutting surface 71*m* such as shown in FIG. 14B. For some applications the total area associated with primary cutting surface 71*m* and secondary cutting surface 82*m* may be approximately equal to previously described cutting surfaces 71 and 82 of cutting element 60.

Depending upon downhole drilling conditions, cutting elements may be formed in accordance with teachings of the present disclosure with substrates and/or protectors having a wide variety of noncircular configurations. The use of such noncircular configurations may depend upon characteristics of an associated downhole formation. Examples of noncircular configurations which may be used to form a cutting element in accordance with teachings of the present disclosure include cutting element 60*m*. Cutting element 60*n* having a sextagonal configuration (see FIG. 14C), cutting element 60*p* having a generally pentagonal cross section (see FIG. 14D) and cutting element 60*q* having the cross section of a trapezoid (see FIG. 14E) represent additional examples of such noncircular configurations.

Figure 15:
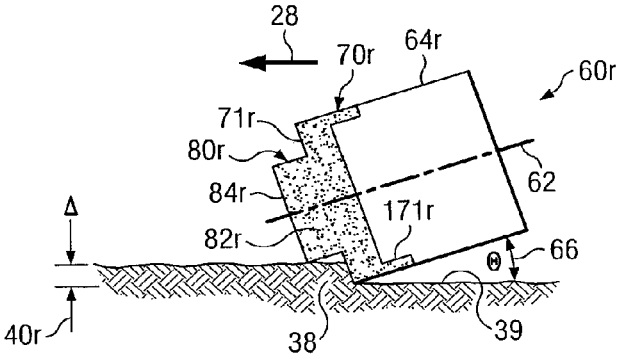
FIG. 15 is a schematic drawing showing an isometric view with portions broken away of another cutting element incorporating teachings of the present disclosure engaged with adjacent portions of a downhole formation.

FIG. 15 shows a further example of a cutting element formed in accordance with teachings of the present disclosure. Cutting element 60*r* may include substrate 64*r* with cutting layer 70*r* disposed on one end thereof. Cutting layer 70*r* may sometimes be described as having "deep ring" 181*r* of hard cutting material extending from cutting layer 70*r* over exterior portions of substrate 64*r*. Protector 80*r* may also extend from cutting surface 71*r*. Protector 80*r* may include cutting layer 84*r* formed from substantially the same material as cutting layer 70*r*. As a result primary cutting surface 71*r* and secondary cutting surface 82*r* may also be formed from substantially the same hard cutting materials. Cutting layer 70*r* may also include sidewall cutting surfaces in addition to cutting surface 71*r*.

Figure 16:
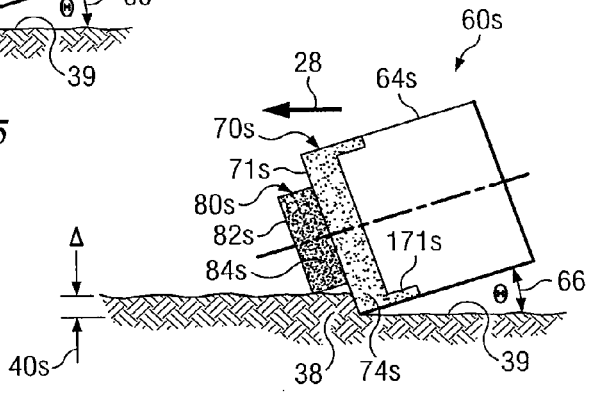
FIG. 16 is a schematic drawing showing an isometric view with portions broken away of still another cutting element incorporating teachings of the present disclosure engaged with adjacent portions of a downhole formation.

Another example of a cutting element incorporating teachings of the present disclosure is shown in FIG. 16. Cutting element 60*s* may include substrate 64*s* with cutting layer 70*s* disposed on one end thereof. Cutting layer 70*s* may sometimes be described as having "deep ring" 181*s* of hard cutting material extending from cutting layer 70*s* over exterior portions of substrate 64*s*. The dimensions of cutting layer 70*s* may be selected such that primary cutting surface 71*s* corresponds with previously described primary cutting surface 71*s* of cutting element 60. Protector 80*s* may be formed on cutting layer 70*s* extending from primary cutting surface 71*s*. Protector 80*s* may have similar dimensions and configurations as previously described protector 80 of cutting element 60. However, cutting layer 84*s* associated with protector 80*s* may be formed from substantially different material as compared to the hard cutting material used to form cutting layer 70*s* of cutting element 60*s*. Cutting layer 70*s* may also include sidewall cutting surfaces in addition to cutting surface 71*s*.

Figure 17:
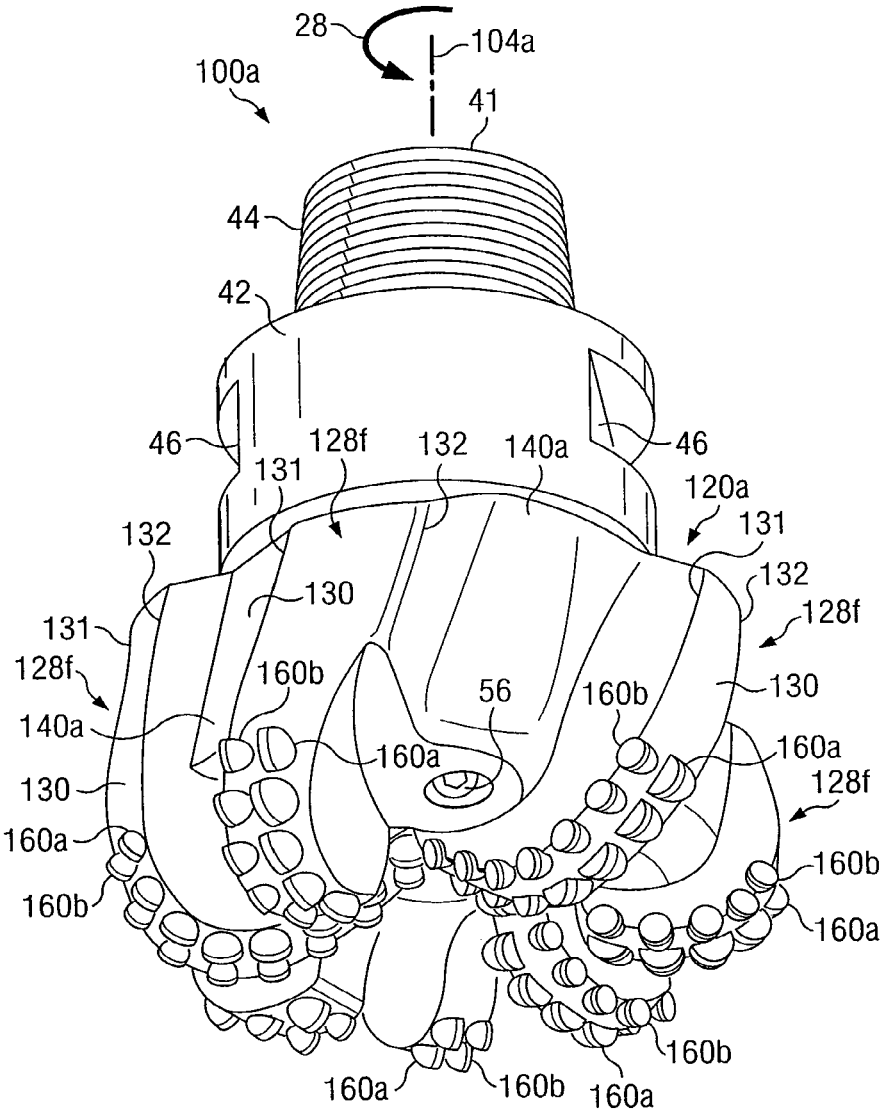
FIG. 17 is a schematic drawing showing an isometric view of another example of a rotary drill bit incorporating teachings of the present disclosure.

FIG. 17 is a schematic drawing showing another example of a rotary drill bit and a plurality of cutting elements incorporating teachings of the present disclosure. Rotary drill bit 100*a* may include bit body 120*a* with a plurality of blades 128*f* extending therefrom. Bit body 120*a* may include previously described upper portion or shank including threads 44 and bit breaker slots 46. Rotary drill bit 100*a* may be releasably engaged with a drill string to allow rotation of rotary drill bit 100*a* relative to bit rotational axis 104*a*. A longitudinal bore (not expressly shown) may extend through bit body 120*a* in the same manner as previously described with respect to rotary drill bit 100. A plurality of respective junk slots or fluid flow slots 140*a* may be formed between respective pairs of blades 128*f*.

For embodiments of the present disclosure as represented by rotary drill bit 100*a*, pairs or sets of cutting elements 160*a* and 160*b* may be disposed on exterior portions of each blade 128*f*. Each blade 128*f* may include leading edge 131 and trailing edge 132. For embodiments of the present disclosure as represented by rotary drill bit 100*a* each secondary cutting element 160*b* may be disposed in a "leading" position relative to associated primary cutting element 160*a*.

Some rotary drill bits have previously been designed with a primary cutting element in a leading position and a secondary cutting element or impact arrestor in a trailing position. For such arrangements the impact arrestor or secondary cutting element often provided less than desired ability to control rate of penetration of an associated rotary drill bit. A relatively large rate of penetration (ROP) may often be required before a trailing secondary cutter or trailing impact arrestor (not expressly shown) will contact adjacent portions of a downhole formation. The required minimum rate of penetration ($ROP_{minimum}$) before a trailing secondary cutter or trailing impact arrestor will contact adjacent portions of a downhole formation may be calculated using the following equation:

$$ROP_{minimum}=5\times RPM\times 360\times \Delta/d\theta$$

where Δ is the designed cutting of a primary cutting before an associated secondary cutting surface contacts adjacent portions of a downhole formation. Δ may also be a difference in inches between exposure of a primary cutting surface and an associated secondary cutting surface as measured from an associated bit face profile.

dθ is the number of degrees the secondary cutting element trails the primary cutting element.

dθ also corresponds with the angular separation between the primary cutting element and the secondary cutting element measured from an associated bit rotation axis.

Typical values for some fixed cutter rotary drill bits may be Δ=0.06 inches and RPM=120. When a primary cutter and an associated secondary cutter are disposed on the same blade such as shown in FIG. 17, typical values of dθ may be approximately one degree (1°) or two degrees (2°). When a primary cutter and an associated secondary cutter are disposed on respective blades, the value dθ may vary depending upon the number of blades disposed on exterior portions of the fixed cutter drill bit.

For some applications with a primary cutter and a secondary cutter disposed on respective blades the value of dθ may be approximately twenty (20°) degrees. The calculated minimum rate of penetration ($ROP_{minimum}$) required before contact occurs between the secondary cutting element and adjacent portions of the downhole formation with dθ=twenty (20°) degrees may be approximately six hundred fifty (650) feet per hour indicating that such contact is not likely.

Figure 18A:
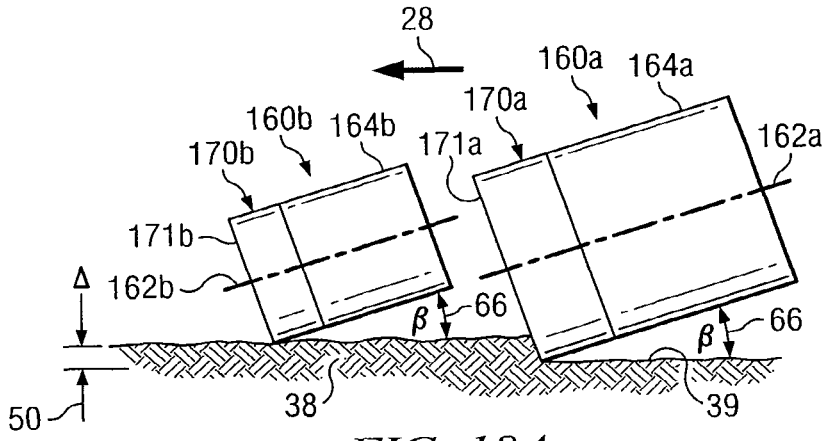
FIG. 18A is a schematic drawing showing a side view of a primary cutting element and associated secondary cutting element incorporating teachings of the present disclosure engaged with adjacent portions of a downhole formation.
Figure 18B:
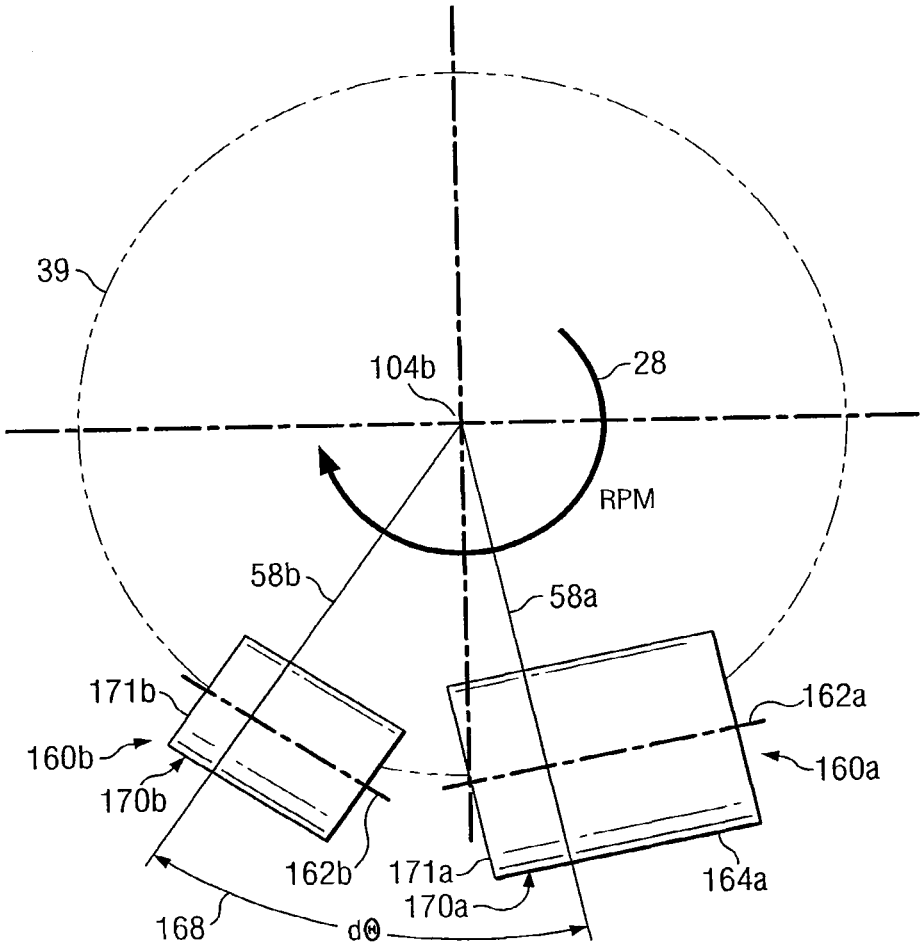
FIG. 18B is a schematic drawing showing a plain view of the pair of cutting elements in FIG. 18A engaged with adjacent portions of a downhole formation.

FIGS. 18A and 18B show a pair or set of cutting elements incorporating teachings of the present disclosure. Primary cutting element 160*a* and associated secondary cutting element 160*b* may be disposed approximately the same radial distance from bit rotational axis 104*b*. See for example, circle 48 as shown in FIG. 18B. Radius 58*a* extending from bit rotational axis 104*b* to cutting element 160*a* may be approximately equal to radius 58*b* extending from bit rotational axis 104*b* to associated secondary cutting element 160*b*. As a result both primary cutting surface 171*a* and secondary cutting surface 171*b* may follow approximately the same path represented by circle 48 during rotation of an associated rotary drill bit.

For embodiments such as shown in FIGS. 18A and 18B, primary cutting element 160*a* may include substrate 164*a* with layer 170*a* of hard cutting material disposed on one end thereof. Secondary cutting element 170*b* may include substrate 164*b* with a layer of hard cutting material 170*a* disposed on one end thereof. Various characteristics and features of cutting elements 160*a* and 160*b* may be described with respect to respective central axis 162*a* and 162*b*.

For embodiments represented by the pair or set of cutting elements 160*a* and 160*b*, the configuration and dimensions of substrate 164*a* and associated layer 170*a* of hard cutting material may be larger than the corresponding configuration and dimensions of substrate 164*b* and layer 170*b* of hard cutting material. However, for other applications a pair or set of a primary cutting element and an associated secondary cutting element may have substantially the same overall dimensions and configuration.

Substrates 164*a* and 164*b* may have generally cylindrical configurations. Respective cutting layers 170*a* and 170*b* may also have generally circular configurations similar to previously described cutting layer 70. However, dimensions associated with cutting layer 170*b* may be less than corresponding dimensions of cutting layer 170*a*. For example, diameter ($D_b$) of secondary cutting surface 171*b* may be smaller than diameter ($D_a$) of primary cutting surface 171*a*. Substrates 164*a* and 164*b* may be formed from tungsten carbide or other materials associated with forming cutting elements on rotary drill bits.

Primary cutting element 160*a* may be disposed on exterior portions of an associated rotary drill bit such that primary cutting surface 171*a* is more exposed as compared to secondary cutting surface 171*b* of secondary cutting element 160*b*. As a result, designed cutting depth (Δ) 50 represents the difference between exposure of cutting surface 171*a* as compared to the exposure of cutting surface 171*b* relative to adjacent portions of an associated downhole formation. The exposure of cutting surface 171*a* and 171*b* may also be described as the distance each cutting surface extends from an associated bit face profile. See FIG. 21B.

Another aspect of the present disclosure includes placing secondary cutting element 160*b* in a leading position relative to primary cutting element 160*a*. The difference in exposure between secondary cutting surface 171*b* of secondary cutter 160*b* and primary cutting surface 171*a* of cutting element 160*b* may be designed to correspond with a desired amount of wear on primary cutting surface 171*a*. As a result of the difference in exposure or designed cutting depth (Δ) 50, secondary cutter 160*b* will generally not contact adjacent portions of downhole formation 38 until the wear on primary cutting surface 171*a* equals the designed cutting depth (Δ) 50. When actual wear depth of primary cutting surface 171*a* equals the designed cutting depth (Δ) 50, secondary cutter 160*b* will become the primary or major cutter. The primary cutter 160*a* may continue to slightly contact adjacent portions of downhole formation 38.

As a result of placing secondary cutting element 160*b* in a leading position relative to primary cutting element 160*a*, the angular difference between the location of primary cutting element 160*a* and secondary cutting element 160*b* relative to bit rotational axis 104*b* may be represented by angle (dθ) 168. However, secondary cutting element 160*b* trails primary cutting element 160*a* by 360°−dθ. The minimum rate of penetration ($ROP_{minimum}$) at which secondary cutting element 160*b* may engage adjacent portions of downhole formation 38 can be calculated using the following formula:

$$ROP_{minimum}=5\times RPM\times 360\times \Delta/(360-d\theta)(\text{ft/hr})$$

For example, when designed depth of cut (Δ) 50 equals 0.06 inches, RPM equals 120, (revolutions per minute) and dθ equals 3 degrees, calculated minimum rate of penetration will be approximately 36.3 ft/hr when cutting surface 171*b* of secondary cutting element 160*b* contacts adjacent portions of a downhole formation. This example shows that when ROP is larger than 36.3 ft/hr, secondary cutting element 160*b* may contact adjacent portions of downhole formation 38 to control ROP of an associated rotary drill bit.

For some applications primary cutting element 160*a* and associated secondary cutting element 160*b* may be disposed on the same blade. See FIG. 17. For other applications primary cutting element 160*a* may be disposed on one blade and associated secondary cutting element 160*b* may be disposed on a respective blade (not expressly shown). Blades carrying secondary cutting element 160*b* will generally be placed in a leading position relative to blades with the primary cutting element 160*a*.

For some applications primary cutting layer 174*a* may be formed from the same material as secondary cutting layer 174*b*. For other applications primary cutting layer 174*a* may be formed from material which is softer than the material used to form secondary cutting layer 174*b* on associated secondary cutting element 160*b*. For such embodiments, when actual wear depth of primary cutting surface 171*a* of cutter 160*a* equals the designed cutting depth, remaining portion of primary cutting surface 171*a* may continue to wear faster than the secondary cutting surface 171*b* of secondary cutter 160*b*.

For some applications computer simulations may be used to energy balance an associated rotary drill bit when primary cutting element 160*a* are forming adjacent portions of a wellbore. Similar computer simulations may also be used to energy balance of the associated rotary drill bit when secondary cutting element 160*b* are forming portions of the same wellbore.

FIG. 19 shows an alternative embodiment of a pair or set of cutting elements incorporating teachings of the present disclosure. The pair or set may include previously described primary cutting element 160*a*. Secondary cutting element 260*b* may be formed with previously described substrate 164*b* and cutting layer 170*b*. However, for embodiments represented by secondary cutting element 260*b*, protector 280 may extend from secondary cutting surface 171*b*. Protector 280 may be formed from various types of hard cutting material. Protector 280 may also include cutting surface 282.

A pair of cutting elements such as shown in FIG. 19 may have three separate designed cutting depths. First designed cutting depth ($\Delta_1$) 50*a* may correspond with depth of cut of primary cutting surface 171*a* before associated secondary cutting surface 171*b* contacts adjacent portions of downhole formation 38 or the difference between exposure of primary cutting surface 171*a* and secondary cutting surface 171*b*. Second designed cutting depth ($\Delta_2$) 50*b* may correspond with depth of cut of primary cutting surface 171*a* before cutting surface 282 of protector 280 contacts adjacent portions of downhole formation 38.

When primary cutting surface 171*a* experiences sufficient wear (sometimes referred to as "designed wear") such that secondary cutting element 260*b* becomes the primary or major cutter, third designed depth ($\Delta_3$) 50*c* may become important. Third designed cutting depth ($\Delta_3$) 50*c* may correspond with depth of cut by cutting surface 171*b* prior to cutting surface 282 contacting adjacent portions of downhole formation 38. Third designed cutting depth ($\Delta_3$) 50*c* may be calculated based on an associated rotary drill bit exceeding a calculated maximum rate of penetration while forming a wellbore using cutting surface 171*b*.

Figure 20:
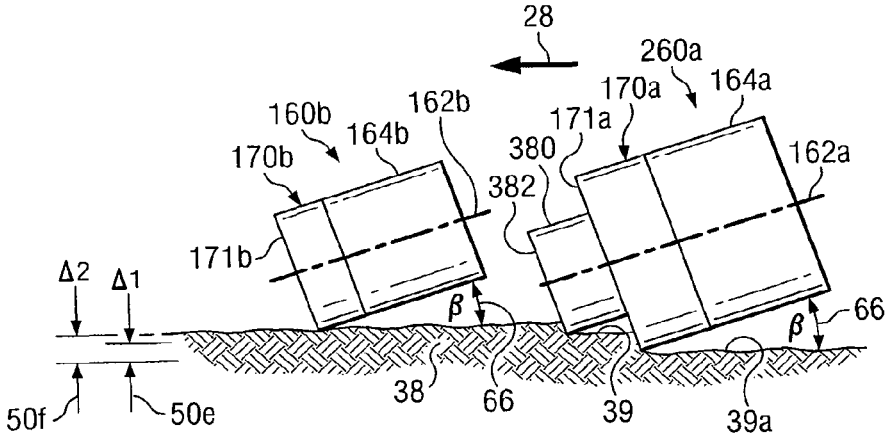
FIG. 20 is a schematic drawing with portions broken away showing a primary cutting element and associated secondary cutting element incorporating teachings of the present disclosure engaged with adjacent portions of a downhole formation.

FIG. 20 shows still another embodiment of a pair or set of cutting elements incorporating teachings of the present disclosure. The pair or set may include primary cutting element 260*a* and previously described secondary cutting element 160*b*. Primary cutting element 260*a* may be formed with previously described substrate 164*a*, cutting layer 170*a* and primary cutting surface 171*a*. For embodiments represented by cutting element 260*a*, protector 380 may extend from primary cutting surface 171*a*. Protector 380 may be formed from various types of hard cutting material. Protector 380 may also include cutting surface 382.

A pair of cutting elements such as shown in FIG. 20 may have at least two separate designed cutting depths. First designed cutting depth ($\Delta_1$) 50*e* may correspond with depth of cut of primary cutting surface 171*a* before cutting surface 382 of protector 380 contacts adjacent portions of downhole formation 38.

When primary cutting surface 171*a* experiences sufficient wear (sometimes referred to as "designed wear") such that secondary cutting element 160*b* becomes the primary or major cutter, second designed cutting depth ($\Delta_2$) 50*f* may become important. Second designed cutting depth ($\Delta_2$) 50*f* may correspond with the total designed wear for both cutting surface 171*a* and cutting surface 382 after which secondary cutting element 160*b* may become the primary or major cutter.

Some rotary drill bits may be generally described as having three components or three portions for purposes of designing cutting elements and an associated rotary drill bit and/or simulating forming a wellbore using the cutting elements and associated rotary drill bit incorporating teachings of the present disclosure. The first component or first portion may be described as "face cutters" or "face cutting elements" which may be primarily responsible for drilling action associated with removal of formation materials to form an associated wellbore. For some types of rotary drill bits the "face cutters" may be further divided into three segments such as "inner cutters," "shoulder cutters" and/or "gage cutters". See, for example, FIG. 21A.

The second portion of a rotary drill bit may include an active gage or gages responsible for maintaining a relatively uniform inside diameter of an associated wellbore by removing formation materials adjacent portions of the wellbore. An active gage may contact and intermittently removing material from sidewall portions of a wellbore.

The third component of a rotary drill bit may be described as a passive gage or gages which may be responsible for maintaining uniformity of adjacent portions of the wellbore (typically the sidewall or inside diameter) by deforming formation materials in adjacent portions of the wellbore but not removing such materials.

Gage cutters may be disposed adjacent to active and/or passive gages. However, gage cutters are generally not considered as part of an active gage or passive gage for purposes of simulating forming a wellbore with an associated rotary drill bit. The present disclosure is not limited to designing cutting elements for only rotary drill bits with the previously described three components or portions of a rotary drill bit.

Figure 21A:
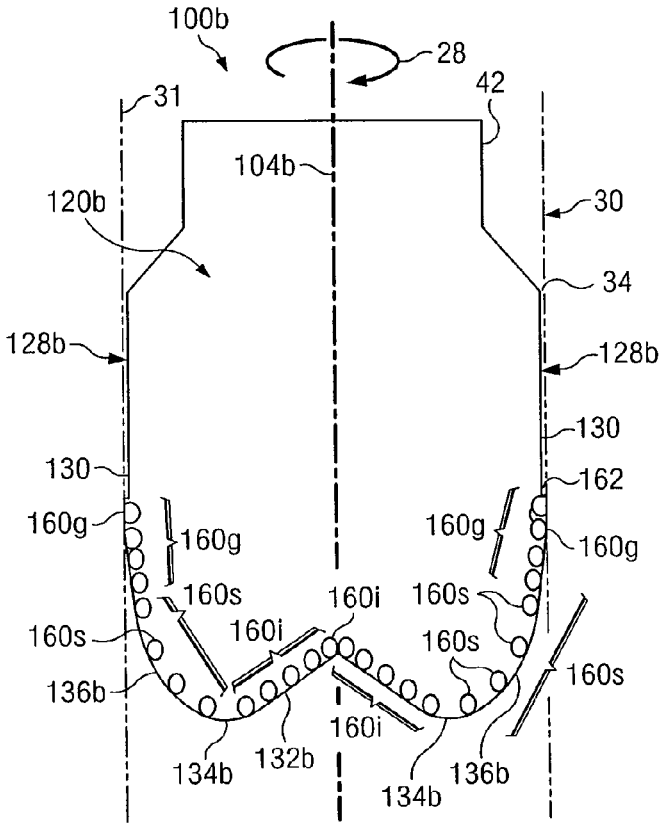
FIG. 21A is a schematic drawing in section with portions broken away showing one example of a rotary drill bit with cutting elements incorporating teachings of the present disclosure.

For embodiments such as shown in FIG. 21A rotary drill bit 100*b* may be described as having gage surface 130 disposed on exterior portion of each blade 128*b*. Gage surface 130 of each blade 128*b* may also include one or more active gage elements (not expressly shown). Active gage elements may be formed from various types of hard, abrasive materials. Active gage elements may sometimes be described as "buttons" or "gage inserts". Active gage elements may contact adjacent portions of a wellbore and remove some formation materials as a result of such contact.

Exterior portions of bit body 120*b* opposite from upper end or shank 42 as shown in FIG. 21A may be generally described as a "bit face" or "bit face profile." The bit face profile for rotary drill bit 100*b* may include recessed portion or cone shaped section 132*b* formed on the end of rotary drill bit 100*b* opposite from upper end or shank 42. Each blade 128*b* may include respective nose 134*b* which defines in part an extreme end of rotary drill bit 100*b* opposite from upper portion 42. Cone section 132*b* may extend inward from respective nose 134*b* of each blade 128*b* toward bit rotational axis 104*b*. A plurality of cutting elements 160*i* may be disposed on portions of each blade 128*b* between respective nose 134*b* and rotational axis 104*b*. Cutters 160*i* may be referred to as "inner cutters".

Each blade 128*b* may also be described as having respective shoulder 136*b* extending outward from respective nose 134*b*. A plurality of cutter elements 160*s* may be disposed on each shoulder 136*b*. Cutting elements 160*s* may sometimes be referred to as "shoulder cutters." Shoulder 136*b* and associated shoulder cutters 160*s* may cooperate with each other to form portions of the bit face profile of rotary drill bit 100*b* extending outwardly from cone shaped section 132*b*. A plurality of gage cutters 160*g* may also be disposed on exterior portions of each blade 128*b* adjacent to associated gage surfaces 130.

One of the benefits of the present disclosure may include designing a rotary drill bit having an optimum number of inner cutters, shoulder cutters and gage cutters with respective protectors providing desired steerability and/or controllability characteristics. Another benefit of the present disclosure may include providing pairs or sets of cutting elements on exterior portions of an associated rotary drill bit to increase the downhole drilling life of the associated drill bit. Cutting elements 160*i*, 160*s* and 160*g* as shown in FIG. 21 may have a wide variety of configurations and designs such as shown in FIGS. 3A-16 and/or FIGS. 18A-20.

Rotary drill bit 100*b* as shown in FIG. 21A may be described as having a plurality of blades 128*b* with a plurality of cutting elements 160*i*, 160*s* and 160*g* disposed on exterior portions of each blade 128*b*. For some applications each cutting element 160*i*, 160*s* and/or 160*g* may represent a pair of primary and secondary cutting elements incorporating teachings of the present disclosure.

Figure 21B:
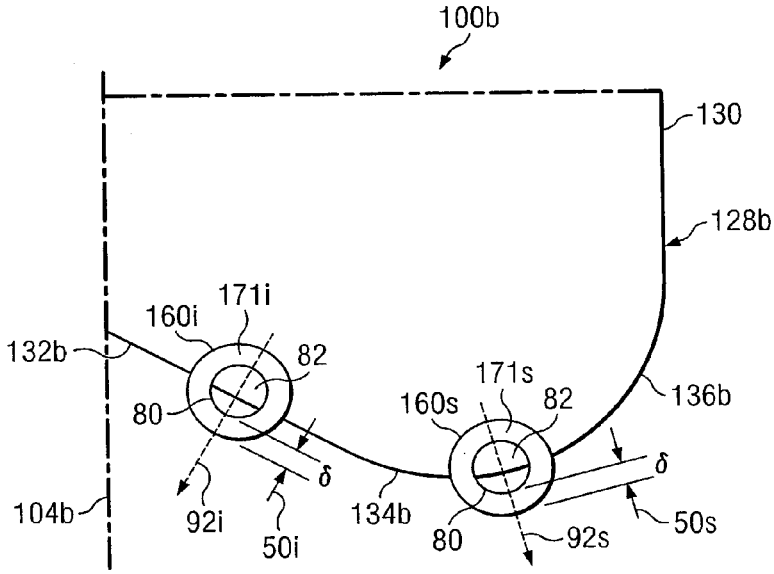
FIG. 21B is a schematic drawing in section with portions broken away showing one example of techniques used to measure or calculate exposure of one or more cutting surfaces of a cutting element disposed on a rotary drill bit in accordance with teachings of the present disclosure.

FIG. 21B is a schematic drawing showing an enlarged view of a portion of rotary drill bit 100*b* with blade 128*b* having cutting elements 160*i* and 160*s* and respective protectors 80 disposed thereon. Respective cutting face axis 92*i* for cutting element 160*i* may extend generally normal or perpendicular to adjacent portion of the bit face profile represented by cone section 132*b*. Cutting face axis 92*s* of cutting element 160*s* may also extend generally normal to adjacent portion of the bit face profile represented by shoulder 136*b*. Respective values of designed cutting depth associated with respective cutting surface 171*i* and 171*s* may correspond with differences between exposure (δ) 50*i* and 50*s* of respective cutting surfaces 171*i* and 171*s* and cutting surfaces 82 formed on associated protectors 80. The difference in exposure (δ) 50*i* and 50*s* may also correspond with respective designed cutting depths for cutting elements 160*i* and 160*s* before associated cutting surfaces 82 may contact adjacent portions of a downhole formation.

FIG. 22A shows one method or procedure for designing cutting elements having a protector which may be used to limit the depth of cut of an associated cutting element. The method will begin at step 400. At step 402 a wide variety of downhole drilling parameters such as revolutions per minute and weight on bit may be input into a computer program or algorithm incorporating teachings of the present disclosure. Additional examples of such downhole drilling parameters or downhole drilling conditions are shown in Appendix A. Drilling equipment data, wellbore data and formation data may be included in step 402.

At step 404 a maximum allowed rate of penetration for the drill bit corresponding with the drill bit data input into the software application at step 402 may be inputted into the software program or algorithm. At step 406 the total number of cutters on the drill bit may be inputted into the software program or algorithm.

At step 408 various geometric parameters for each cutting element or cutter such as cutter diameter, protector diameter and cutter backrake angle may be selected. Additional cutter geometric parameters and/or design characteristics as previously discussed in this application may also be inputted. At step 410 the maximum depth of cut of each cutter during one bit revolution may be calculated based on the previously input maximum allowed rate of penetration for the rotary drill bit. At step 412 the length of protector may be calculated for the associated cutting element using the formula $L=0.5\times(D-d)\times\cos(\beta)-\Delta_{max}/\sin\beta$.

At step 414 the calculated length of the respective protector may be compared with an allowable range of protector lengths. If the calculated protector length is satisfactory, the software application or algorithm will proceed to step 416. If the calculated step is not satisfactory, the software application or algorithm will return to step 408 to select alternative cutter geometric parameters. Steps 408, 410 and 412 may be repeated until the calculated length of the respective protector is in the allowable range. At this time the software application or algorithm will proceed to step 416. If the cutter being considered is the last cutter or the K cutter, the software application or algorithm will then end by proceeding to step 418. If the cutter being considered is not the last cutter, the software application or algorithm will return to step 406.

FIG. 22B is a block diagram showing one method or procedure which may be used to design a rotary drill bit, pairs of cutting elements with or without protectors whereby an associated secondary cutter may be used to extend the downhole drilling life of the rotary drill bit. The method will begin at step 500.

At step 502 a wide variety of downhole drilling parameters such as revolutions per minute and weight on bit may be input into a computer program or algorithm incorporating teachings of the present disclosure. Additional examples of such downhole drilling parameters or downhole drilling conditions are shown in Appendix A. Drilling equipment data, wellbore data and formation data may be included in step 502.

At step 504 the total number of cutters for the drill bit design selected in step 502 may be input into the software program or algorithm. At step 506 the maximum designed wear or expected wear for the primary cutter in each pair of cutters may be input into the software program or algorithm. At step 508 various geometric parameters for both the primary and secondary cutters such as cutter diameter, protector diameter (if applicable) and cutter backrake angle may be inputted into the software application or algorithm. Additional cutter geometric parameters and/or design characteristics as previously discussed in this application may be inputted into the software application or algorithm.

At step 510 (if applicable) the length of each protector associated with the primary cutter and/or the secondary cutter may be calculated using the same formula as previously discussed with respect to step 412 in FIG. 21A. At step 512 the calculated length of each protector may be compared with an allowable range of protector lengths. If the calculated length is acceptable, the software application or algorithm will proceed to step 514. If the calculated length for one or more protectors is not within the allowable range, the software application or algorithm will return to step 508.

At step 514 the angular degrees between the primary cutter and the secondary cutter may be calculated and input into the software application. At step 516 the rate of penetration at which the secondary cutter will contact adjacent formation materials may be calculated based on the designed wear or maximum wear depth of the primary cutter. At step 518 the calculated rate of penetration for contact by the secondary cutter is evaluated. If the rate of penetration of contact by the secondary cutter with the adjacent formation material is not satisfactory, the software application or algorithm will return to step 504. If the rate of penetration of contact by the secondary cutter is satisfactory, the software application or algorithm will proceed to step 520. At step 520 the software application or algorithm will determine if the cutter being evaluated is the last cutter. If the answer is YES, the software application or algorithm will proceed to step 522 and end. If the answer is NO, the software application or algorithm will return to step 504 and repeat steps 504 through 520 until all cutters have been evaluated.

Although the present disclosure and its advantages have been described in detail, it should be understood that various changes, substitutions and alternations can be made herein without departing from the spirit and scope of the disclosure as defined by the following claims.

APPENDIX A

EXAMPLES OF DATA RELATED TO DOWNHOLE DRILING CONDITIONS OR PARAMETERS

| EXAMPLES OF DRILLING EQUIPMENT DATA | | EXAMPLES OF WELLBORE | EXAMPLES OF FORMATION |
|---|---|---|---|
| Design Data | Operating Data | DATA | DATA |
| active gage | axial bit penetration rate | azimuth angle | compressive strength |
| bend (tilt) length | bit ROP | bottom hole configuration | down dip angle |
| bit face profile | bit rotational speed | bottom hole pressure | first layer |
| bit geometry | bit RPM | bottom hole temperature | formation plasticity |
| blade (length, number, spiral, width) | bit tilt rate | directional wellbore | formation strength |
| bottom hole assembly | equilibrium drilling | dogleg severity (DLS) | inclination |
| cutter (type, size, number) | kick off drilling | equilibrium section | lithology |
| cutter density | lateral penetration rate | horizontal section | number of layers |
| cutter location (inner, outer, shoulder) | rate of penetration (ROP) | inside diameter | porosity |
| cutter orientation (backrake, side rake) | revolutions per minute (RPM) | kick off section | rock pressure |
| cutting area | side penetration azimuth | profile | rock strength |
| cutting depth | side penetration rate | radius of curvature | second layer |
| cutting structures | steer force | side azimuth | shale plasticity |
| drill string | steer rate | side forces | up dip angle |
| fulcrum point | straight hole drilling | slant hole | |
| gage gap | tilt rate | straight hole | |
| gage length | tilt plane | tilt rate | |
| gage radius | tilt plane azimuth | tilting motion | |
| gage taper | torque on bit (TOB) | tilt plane azimuth angle | |
| IADC Bit Model | walk angle | trajectory | |
| impact arrestor (type, size, number) | walk rate | vertical section | |
| passive gage | weight on bit (WOB) | | |
| worn (dull) bit data | | | |

What is claimed is:

1. A method for designing a drill bit including cutting elements having a protector operable to control a depth of cut of the associated cutting element in a downhole formation, comprising:

(a) selecting, by a processor, a downhole drilling parameter;

(b) determining, by the processor, a maximum rate of penetration (ROP) based on the downhole drilling parameter;

(c) calculating, by the processor, maximum depth of cut for a cutting element based on the maximum ROP;

(d) selecting, by the processor, an effective diameter and a back rake angle for the cutting element, and an effective diameter for the protector, wherein the protector is integrated in the cutting element;

(e) calculating, by the processor, a protector length based on:

a difference between the effective diameter of the cutting element and the effective diameter of the protector, the back rake angle of the cutting element, and the maximum depth of cut of the cutting element;

(f) comparing, by the processor, the calculated protector length with an allowable range of protector lengths; and (g) if the calculated protector length is not in the allowable range of protector lengths, reselecting, by the processor the effective diameter of the cutting element, the back rake angle of the cutting element, or the effective diameter of the protector until the calculated protector length is in the allowable range of protector lengths.

2. The method of claim 1, wherein the downole drilling parameter comprises at least one of revolutions per minute (RPM), weight on bit, formation compressive strength, and formation hardness.

3. The method of claim 1, wherein the protector length is determined based on the formula:

$$L=0.5\ (D-d)\cos(\beta)-\Delta_{max}/\sin(\beta);\ \text{where}$$

L corresponds to the protector length;

D corresponds to the effective diameter of the cutting element;

d corresponds to the effective diameter of the protector;

$\Delta_{max}$ corresponds to the maximum depth of cut of the cutting element; and β corresponds to the backrake angle of the cutting element.

4. The method of claim 1, further comprising:

(h) determining, by the processor, a maximum number of cutting elements to be placed on the drill bit; and (i) performing steps (c) through (g) for each of the cutting elements.

5. The method of claim 1, further comprising notifying, by the processor, a user if the calculated protector length is not in the allowable range of protector lengths.

6. A non-transitory computer readable medium storing instructions for designing a drill bit including cutting elements having a protector operable to control a depth of cut of the associated cutting element in a downhole formation, the instructions, when executed by a processor configured to:

(a) select a downhole drilling parameter;

(b) determine a maximum rate of penetration (ROP) based on the downhole drilling parameter;

(c) calculate maximum depth of cut for the cutting element based on the maximum ROP;

(d) select an effective diameter and a back rake angle for the cutting element, and an effective diameter for the protector, wherein the protector is integrated in the cutting element;

(e) calculate a protector length based on:

a difference between the effective diameter of the cutting element and the effective diameter of the protector, the back rake angle of the cutting element, and the maximum depth of cut of the cutting element;

(f) compare the calculated protector length with an allowable range of protector lengths; and (g) if the calculated protector length is not in the allowable range of protector lengths, reselect the effective diameter of the cutting element, the back rake angle of the cutting element, or the effective diameter of the protector until the calculated protector length is in the allowable range of protector lengths.

7. The non-transitory computer readable medium of claim 6, wherein the downole drilling parameter comprises at least one of revolutions per minute (RPM), weight on bit, formation compressive strength, and formation hardness.

8. The non-transitory computer readable medium of claim 6, wherein the protector length is determined based on the formula:

$$L=0.5\ (D-d)\cos(\beta)-\Delta_{max}/\sin(\beta);\ \text{where}$$

L corresponds to the protector length;

D corresponds to the effective diameter of the cutting element;

d corresponds to the effective diameter of the protector;

$\Delta_{max}$ corresponds to the maximum depth of cut of the cutting element.

9. The non-transitory computer readable medium of claim 6, wherein the instructions are further configured to:

(h) determine a maximum number of cutting elements to be placed on the drill bit; and (i) perform steps (c) through (g) for each of the cutting elements.

10. The non-transitory computer readable medium of claim 6, wherein the instructions are further configured to notify a user if the calculated protector length is not in the allowable range of protector lengths.

* * * * *